US011598154B2

(12) United States Patent
Hoegger et al.

(10) Patent No.: US 11,598,154 B2
(45) Date of Patent: Mar. 7, 2023

(54) SYSTEM AND METHOD FOR CONDITIONING A DOWNHOLE TOOL

(71) Applicant: Baker Hughes Oilfield Operations LLC, Houston, TX (US)

(72) Inventors: Sven Hoegger, Ettenbuettel (DE); Helmuth Sarmiento Klapper, Hannover (DE); Peter Schorling, Celle (DE); Erik Bartscherer, Celle (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 83 days.

(21) Appl. No.: 16/916,642

(22) Filed: Jun. 30, 2020

(65) Prior Publication Data

US 2021/0002963 A1 Jan. 7, 2021

Related U.S. Application Data

(60) Provisional application No. 62/869,464, filed on Jul. 1, 2019.

(51) Int. Cl.

| | |
|---|---|
| ***E21B 37/00*** | (2006.01) |
| ***E21B 17/00*** | (2006.01) |
| ***E21B 12/00*** | (2006.01) |
| *E21B 41/02* | (2006.01) |

(52) U.S. Cl.

CPC ..... *E21B 12/00* (2013.01); *E21B 17/006* (2013.01); *E21B 37/00* (2013.01); *E21B 41/02* (2013.01)

(58) Field of Classification Search

CPC ..... E21B 37/00; E21B 17/006

See application file for complete search history.

(56) References Cited

U.S. PATENT DOCUMENTS

| | | | |
|---|---|---|---|
| 4,809,778 | A | 3/1989 | Johnson |
| 6,100,616 | A | 8/2000 | Heinig et al. |
| 7,404,446 | B2 | 7/2008 | Du et al. |

(Continued)

OTHER PUBLICATIONS

Kumar et al. "Environmentally Acceptable Corrosion Inhibitor for Filter-Cake Removal System", SPE 165319, CA, Apr. 19-25, 2013, 7 pages.

*Primary Examiner* — Giovanna Wright

(74) *Attorney, Agent, or Firm* — Bracewell LLP; Keith R. Derrington

(57) ABSTRACT

A wellbore tool is conditioned between downhole deployments with a substantially continuous application of a conditioning fluid within the tool. Selectively removable caps connect to ends of the tool after its removal from the wellbore. If the tool is part of a downhole string, the caps are added after the tool is decoupled from the remainder of the string. The conditioning fluid is introduced into the tool through a fitting on one of the end caps; and while a fitting on the other end cap is opened to vent fluids resident within the tool. The caps are in sealing contact with a housing of the tool to retain the conditioning fluid inside the tool. A fluid supply system at the well site provides the conditioning fluid. Example conditioning fluids include a fracturing fluid, a completion fluid, a diluent, a solubilizing agent, an anti-scaling agent, a pH buffer, a liquid freezing point depressant, corrosion and oxidation inhibitors, oxygen scavengers, biocides, surfactants, and combinations thereof.

22 Claims, 12 Drawing Sheets

(56) References Cited

U.S. PATENT DOCUMENTS

| | | | | |
|---|---|---|---|---|
| 9,844,803 | B1 * | 12/2017 | Carter | E21B 17/01 |
| 9,874,074 | B2 | 1/2018 | Soltani | |
| 2004/0007255 | A1 * | 1/2004 | Labib | B08B 9/0327 134/22.12 |
| 2010/0147531 | A1 | 6/2010 | Reid et al. | |
| 2014/0166298 | A1 * | 6/2014 | Fenwick | E21B 33/04 166/360 |
| 2018/0179880 | A1 * | 6/2018 | Sankaran | E21B 12/02 |

* cited by examiner

SYSTEM AND METHOD FOR CONDITIONING A DOWNHOLE TOOL

RELATED APPLICATIONS

This application claims priority to and the benefit of U.S. Provisional Application Ser. No. 62/869,464 filed on Jul. 1, 2019, which is incorporated by reference herein in its entirety and for all purposes.

BACKGROUND OF THE INVENTION

1. Field of Invention

The present disclosure relates to a system and method for exposing a downhole tool to a conditioning fluid while the tool is out of service. More specifically, the present disclosure relates to continuously conditioning a downhole tool with a fluid between deployments of the downhole tool.

2. Description of Prior Art

Oilfield operations include using a number of different types of downhole strings.

Downhole strings typically are made of a number of members joined together at their respective ends, and which are inserted into a wellbore. The members are threaded on their opposing ends, are sometimes engaged directly to one another, or connected by subs that attach to the adjacent members. The members are often downhole tools that are used for a myriad of applications, and over the life of the wellbore. Pipe joints are typically the majority element in a drill string when forming or drilling a wellbore. But it is not uncommon for other types of downhole tools to be included in a drill string; such as tools for logging while drilling, telemetry, and steering. Tools for perforating, fracturing, sensing, cutting, sampling, and imaging are types often used for well completion and remediation. Many of these tools are also deployed downhole on wireline, slick line, or tubing such as coiled tubing.

The downhole tools are generally immersed in fluid while in the wellbore, such as drilling fluid or subterranean formation fluids. While the tools typically have a sealed outer housing, the fluid often makes its way inside of the downhole tools; either by migrating across a seal, or sometimes being purposefully directed into the tool such as drilling fluid pumped through an inner bore of a downhole string. The tools are usually not redeployed soon after being removed from the wellbore. Because solid particles generally are entrained within the fluid; deposits sometimes form inside and on the tool when the tool is on the surface and the fluid dries. The deposits can form even if the fluid is washed from the tool; and are especially hard to remove when such deposits are in cavities inside the tool. Moreover, deposits from drilling mud or formation fluid are sometimes corrosive, and damage the tools or components within by corrosion, stress corrosion cracking or pitting on sealing surfaces. Deposits are also known to cause jamming of moving parts, such as in turbines, valves, or mud motors. As there is no currently known manner of testing some of these devices, the malfunction will not be discovered until the tool is redeployed in the wellbore, thereby introducing significant downtime.

SUMMARY OF THE INVENTION

A method of treating a downhole tool used in a wellbore that includes securing end caps to opposing ends of the downhole tool, introducing a conditioning fluid into the downhole tool through a one of the end caps, so that material in the downhole tool becomes entrained in the conditioning fluid, venting a space within the housing through a different one of the end caps, and forming sealing interfaces between the end caps and housing to retain the conditioning fluid within the housing. The method further optionally includes, draining the conditioning fluid from the downhole tool and redeploying the downhole tool. The material in the downhole tool optionally enters the downhole tool when the downhole tool is used in the wellbore, the method further comprising flushing the conditioning fluid with entrained material from the tool. In this alternative, the material in the downhole tool is one of drilling fluid, components of a drilling fluid, a wellbore treatment fluid, and components of the wellbore treatment fluid. Examples of conditioning fluid are water, a diluent, a solubilizing agent, an anti-scaling agent, a pH buffer, a liquid freezing point depressant, a corrosion inhibitor, an antioxidant, a biocide, a surfactant, a lubricant, and combinations thereof.

Also disclosed is an example method of treating a downhole tool used in a wellbore, and which includes introducing a conditioning fluid into the downhole tool, retaining the conditioning fluid in the downhole tool so that at least a portion of a material in the downhole tool becomes dispersed within the conditioning fluid, and draining the conditioning fluid and dispersed material from the downhole tool. The method optionally includes coupling selectively releasable caps to openings of the downhole tool. In an example, the steps of introducing and draining take place through the caps. The method optionally further includes isolating an electrical receptacle from the conditioning fluid by engaging the electrical receptacle with a connection prong that is coupled with a one of the caps. Another optional step involves discharging fluid from the downhole tool when a pressure in the downhole tool is at a designated value.

A system for treating a downhole tool is also disclosed, which includes a cap that selectively mounts to and seals an opening on the downhole tool, a source of conditioning fluid, and a fitting on the cap that selectively couples with the source of conditioning fluid. Optionally, the cap is a first cap and the system further includes a second cap, wherein the openings are on axial ends of a tool housing provided on an outer surface of the downhole tool. The cap optionally is an annular housing having a cylindrical outer surface, an axis extending along a length of the housing, a bore in the housing extending along a length of the housing, and a cylindrically shaped manifold assembly mounted in an end of the bore. Fluid fittings are optionally mounted on opposing radial surfaces of the manifold assembly, and openings formed radially through the housing adjacent the fluid fittings define access paths to the fluid fittings. An end of the housing distal from the manifold assembly is alternatively a box connection. In one example, an end of the housing distal from the manifold assembly is a pin connection. A connection prong is optionally provided in the housing that selectively engages an electrical receptacle disposed in the tool. The system further optionally includes a fluid supply system made up of a storage tank containing an amount of conditioning fluid, a pump in fluid communication with the storage tank, an inlet line having an end in fluid communication with a discharge of the pump and an end in selective fluid communication with a fitting on the cap, so that when the pump operates, the conditioning fluid is introduced into the downhole tool via the fitting on the cap.

BRIEF DESCRIPTION OF DRAWINGS

Some of the features and benefits of the present invention having been stated, others will become apparent as the description proceeds when taken in conjunction with the accompanying drawings, in which.

Figure 1:
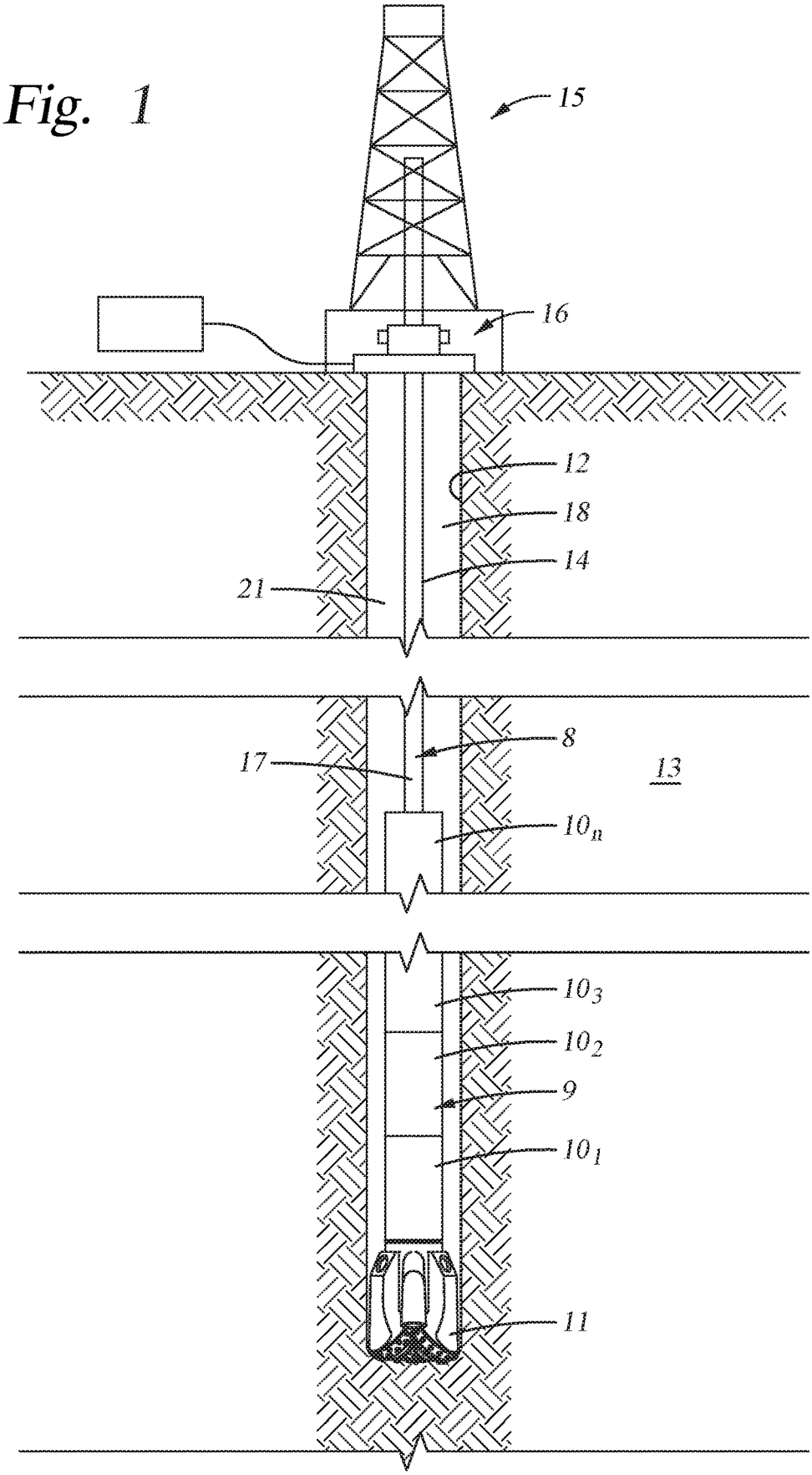
FIGS. 1 and 1A are side partial sectional views of examples of downhole tool strings deployed in a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1A:
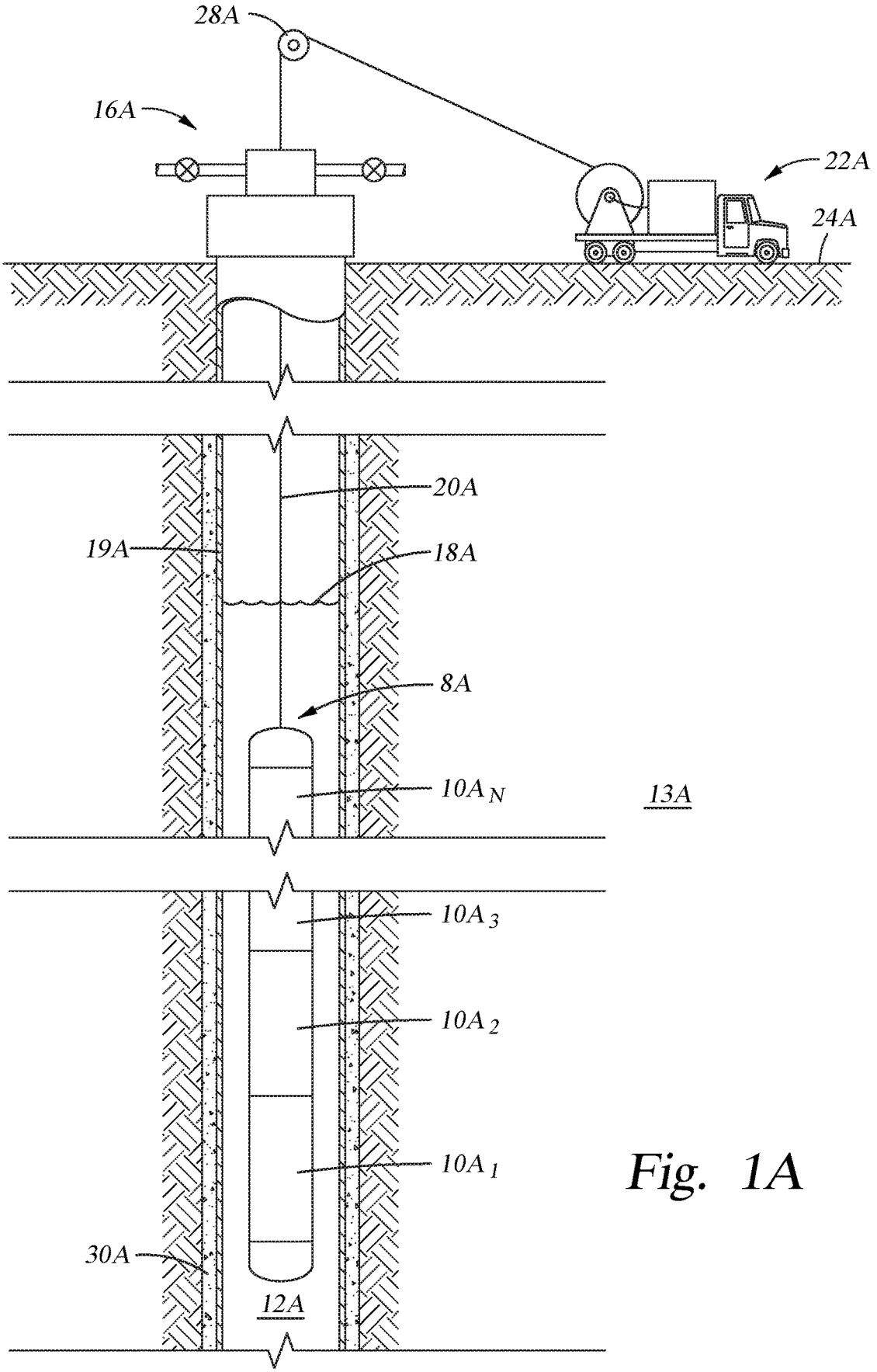

Shown in a side partial sectional view in FIG. 1 is an example of a downhole string 8 that includes a bottom-hole assembly ("BHA") 9 proximate its lower end. In this example, included in BHA 9 are a series of downhole tools $\mathbf{10}_{1\text{-}n}$. A drill bit 11 is depicted on a lowermost end of the BHA 9, and which is used for forming a wellbore 12 shown intersecting a formation 13. The downhole string 8 of FIG. 1 also includes a string of drill pipe 14 shown attached to an upper end of BHA 9. An end of the drill pipe 14 opposite BHA 9 depends into the wellbore 12 from a rig 15. Further in the example of FIG. 1, a wellhead assembly 16 is over an opening of wellbore 12. Alternatives for providing a rotational force to bit 11 include a drill motor (not shown) that is in or makes up a part of one or more of the downhole tools $\mathbf{10}_{1\text{-}n}$. Also illustrated in this example is an inner bore 17 in the downhole string 8, and that the downhole string 8 is immersed in fluid 18 that is in the wellbore 12; examples of the fluid 18 include drilling fluid, a treatment fluid for use in a wellbore, and combinations thereof. In alternatives, fluid 18 is injected into the downhole string 8 and flows through the inner bore 17. Another example of a downhole string 8A is illustrated in a side partial sectional view in FIG. 1A. Downhole string 8A in this example is made up of a number of downhole tools $\mathbf{10}\mathrm{A}_{1\text{-}n}$ that are coupled together on their respective ends, and are arranged in series. The wellbore 12A of FIG. 1A is lined with an annular casing 19A. Similar to downhole string 8 of FIG. 1, downhole string 8A is submerged in fluid 18A; examples of the fluid 18A include drilling fluid, treatment fluid and the like. Optionally, fluid produced from formation 13, 13A and which has entered wellbore 12, 12A makes up all or part of fluid 18, 18A. As depicted, a wireline 20A is the deployment and support means for downhole string 8A; and which has an upper end coupled with a service truck 22A disposed on surface 24A outside wellbore 12A. Alternative deployment means for downhole string 8A include tubulars, such as coiled tubing or a drill pipe. Wireline 20A threads through a wellhead assembly 16A shown mounted at the opening of wellbore 12A, and which in an example provides pressure control over wellbore 12A and further optionally provides a way of controlling production of formation fluids from wellbore 12A. Further in this example of FIG. 1A, wireline 20A routes over a sheave 28A which is rotatingly mounted above wellhead assembly 16A.

The downhole tools $\mathbf{10}_{1\text{-}n}$ considered herein include any type of device or apparatus for use or usable in a wellbore. Example tools include those for perforating, fracturing, formation evaluation (gamma radiation, formation resistivity, nuclear radiation, acoustic time delay, pressure, temperature, formation sampling, imaging), borehole positioning (magnetometer, accelerometer, gyro), directional drilling (steering unit, mud motor), cutting, completion, workover, remediation, intervention, production, and combinations. Types of imaging tools include those for acoustic imaging, electromagnetic imaging, nuclear imaging, resistivity imaging, and those for interrogating the cement 30A that is disposed between casing 19A and wall of wellbore 12A. Example completion tools include ones for perforating or fracturing, example formation tools include those for excavating, example production tools include artificial lift. Drilling fluid 18, 18A include oil based mud, water based mud, synthetic mud and combinations thereof.

Examples of the downhole tools $\mathbf{10}_{1\text{-}n}$ in BHA 9 in FIG. 1 include collar based downhole tools having a body or housing with an outer surface, which in the embodiment shown in FIG. 1 is a downhole tool. An inner bore extends through the body along a longitudinal axis of the body of the downhole tool defining an inner surface and an annular body portion also optionally referred to as collar of the downhole tool. Optionally housed in the collar are downhole devices such as sensors, batteries, electronic boards (e.g. high temperature multi-chip modules (MCM)), connectors, wires, electronic devices (motors, generators), mechanical systems (rods, gear wheels, pivotable elements), and hydraulic systems (pumps, tubes, valves, pistons). The devices are optionally located in a device frame inside the collar (megaframe) or in separate recesses (hatches) located on the outer surface of the body. In an embodiment, the device frame is sealed inside the body by a sleeve slit over the frame. In an alternative, the recesses are closed and sealed by hatch covers placed on the recesses. Examples of power for a collar based tool includes a battery, which is located also in the collar of the body or alternatively, a drilling fluid turbine located in the inner bore of the tool and that is connected to a generator. The generator of this example produces electrical energy when drilling fluid is pumped through the inner bore of the downhole tool that spins the turbine. In alternative embodiments the downhole tools $\mathbf{10}_{1\text{-}n}$ in BHA 9 in FIG. 1 are probe based tools. Probe based tools optionally include a body or housing with an outer surface. In one example, an inner bore extends through the body along a longitudinal axis of the body defines an inner surface. Inside the inner bore of the body optionally includes at least one device container (probe). In an alternative, the device container houses downhole devices, such as sensors, electronic boards (e.g. high temperature MCM), connectors, wires, electronic devices (motors, generators), mechanical systems (rods, gear wheels, pivotable elements), and hydraulic systems (pumps, tubes, valves, pistons). The device container is optionally connected and fixed to the inner surface of the body by at least one connection arm (three connection arms are usual). The device container optionally includes a battery, or alternatively is provided energy by a power line connecting the device container. More than one device containers are communicatively connected by communication lines.

In one example, the inner bore of a collar or probe based tool is used to pump drilling fluid from a mud container into the downhole string through the drill pips, the BHA and the drill bit to the bottom of the wellbore. In this example, the drilling fluid exits the bit through bit nozzles and circulates through an annulus 21 (FIG. 1) between the downhole string and the wellbore wall back to the surface. On its way from the drill bit back to surface the drilling fluid takes drill cuttings, produced by the drill bit during the disintegrating process of the formation, to the surface. In some instances, formation fluids become entrained in the drilling fluid, and gases forming a wellbore fluid comprising beside the drilling fluid various solid, liquid and gaseous substances or materials. Solid materials and other components deemed deleterious to drilling tools and drilling operations are optionally filtered from the drilling fluid prior to being reinjected into the wellbore via the drill string. But in some instances at least some of the solid materials and/or other components remain in the drilling fluid and reenter the wellbore through the downhole string. Examples exist that the drill cuttings and formation fluids and gases of the wellbore fluid enter the downhole tool during the drilling process, and remain in the downhole tool after being removed from the wellbore. Examples exist where the BHA 9 includes a communication tool, such as a mud pulser inside the inner bore of the communication tool. In a non-limiting example of operation the mud pulser generates pressure pulses in the inner bore that travel to surface inside the drilling fluid and are detected by a pressure sensor. Further in this example, the mud pulses carry downhole information that is decoded at surface (uplink). In one embodiment, a bypass actuator at surface is used to generate pressure pulses at surface that travel downhole through the inner bore of the downhole tool and carry information detectable by the tool through RPM variations in the drilling fluid turbine used to produce electrical energy downhole. In an alternative, the information is decoded downhole (downlink).

Examples of connecting downhole tools include pin or box tool connections. Optionally with the connections is a connector member that connects a communication line (bus) from one downhole tool to another downhole tool in the BHA. Examples of connector member include an electrical connector, an optical connector or a connector for a wireless communication. In an embodiment, the connector member is a central connector located inside the inner bore and fixed to the inner surface of the body by connection arms. Further optionally, the connector is a ring connector located in a shoulder of the pin and box tool connection, where examples of the ring connector include a closed ring or a partial ring. In another embodiment the connector is a male/female connector located in a shoulder of the pin and box connection. In an alternative, the female connector is in the pin connection of the tool and the male connector is in a shoulder of the box connection of the tool, or vice versa. Alternative connector types are possible as well. The connector optionally transfers data from one downhole tool to another (communication line/bus) and alternatively transfer power from one downhole tool to another (power line). Embodiments exist where the connector is a one-pin connector that allows connection of the communication line and the power line by a single pin. In an alternative, the tool body is a ground connection and a common downhole bus system is a Powerline bus system.

In an example of a probe based or collar based downhole tool includes inner connections inside the inner bore between portions of the downhole tool, recesses on the inner surface of the body, hatch covers sealing cavities on the inner surface of the body, slits and gaps on the inner surface of the body, turbines, valves, connection arms, device containers, and electrical or optical connectors. Components inside the inner bore of the body are susceptible to damage when wellbore fluid contacts inner surfaces and structures in the inner bore. In an example, aggressive components of the wellbore fluid contain destructive processes that lead to corrosion, stress corrosion cracking, degradation of elastomer based sealing elements such as O-rings, jamming and clogging of openings and moving parts (turbines, valves). In an example, solid particles suspended or entrained in the wellbore fluid collect to form cohesive deposits on the inner surface of the downhole tool and inner structures in the inner bore; in at least some instances the deposits are hard and adhere to the inner surface and/or structures, and require an external force or solvent to be removed. Embodiments exist, that if not removed prior to a subsequent deployment of the tool the deposits and corrosion create damages that cause a tool failure in a subsequent downhole run. In some instances failure in a downhole operation creates high cost due to removing an entire downhole string from the wellbore, and replacing the failed downhole tool with a backup tool. Components and materials of the wellbore fluid which remains in the downhole tool after removal from the wellbore and which start destructive processes in the tool are here referred to as aggressive materials.

Often in existing operations downhole tools are not cleaned after deployment in a wellbore, but are usually laid down on a pipe deck of the rig site without removing wellbore fluid from their inner bores. After resting on the pipe deck for a period of time, the downhole tools are then usually transported from the rig site back to the workshop for maintenance and testing before delivery to the same or a different rig site. Alternatively, the downhole tool is transported from a first wellbore to a second wellbore (from first rig site to second rig site). Depending on whether the rig site is onshore or offshore and depending on the country and the well operator, the time between removing the downhole tools from the wellbore to the arrival at the workshop can take several weeks. This time frame leaves the remaining wellbore fluid time to react with the inner surface of the tool and the described structures inside the inner bore. In locations that have hot and humid climate, such as Latin America or Africa the destructive processes are amplified. When the tool finally reaches the workshop the damages to the tool may have progressed to an extent that a complete disassembly of the tool is required. A complete disassembly of a complex downhole tool such as for example an acoustic tool or a sampling tool may easily take weeks, binding expensive resources (technicians, workshop space) while the tool cannot be redeployed. In such a situation more tools are required to serve a specific contract with a client than necessary. Costs are reduced and utilization increased by avoiding downhole tool degradation by preventing destructive processes caused by retaining wellbore fluid in the inner bore of the downhole tool post deployment. Minimizing the time a downhole tool inner bore is exposed to wellbore fluid also reduces maintenance levels of the downhole tools between deployments. It is to be mentioned that any length of deployment time inside a wellbore that allows contact between wellbore fluid and a downhole tool is sufficient to contaminate the inner bore of the tool with the wellbore fluid and start the destructive processes inside the inner bore of the downhole tool, resulting in a complete disassembly of the downhole tool. A downhole run of only half an hour may lead to a complete disassembly of the tool taking the tool out of order for weeks. Implementation of that in the current disclosure avoids the destructive processes in the inner bore of a downhole tool. A further advantage of the present disclosure is that a downhole tool is in condition for redeployment after a basic performance test, as the tool was basically not used and has used up only a little portion of its operational limit that defines higher maintenance levels.

Figure 2:
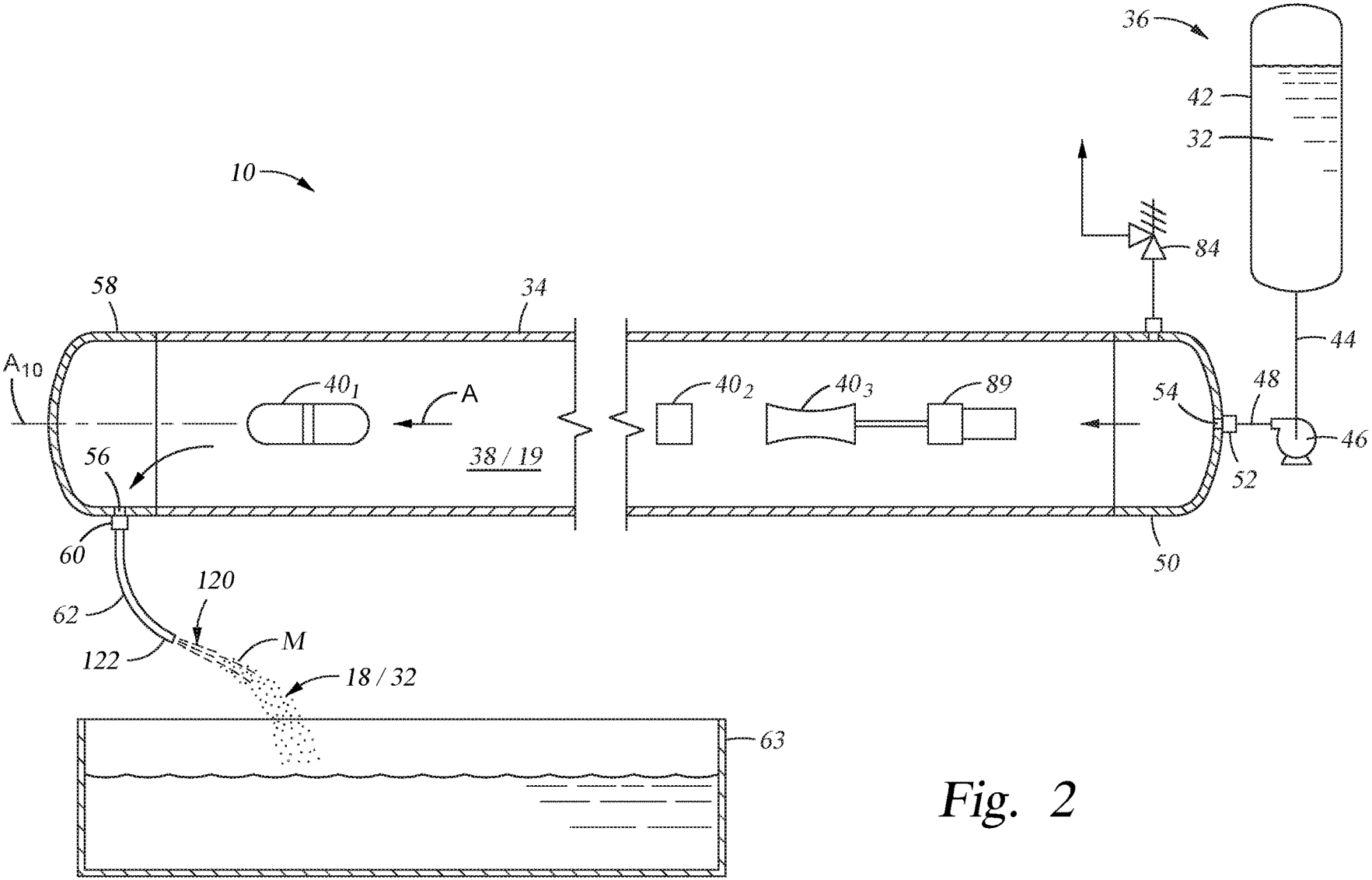
FIG. 2 is a side partial sectional view of an example of introducing a conditioning fluid into a downhole tool.

Shown in a side partial sectional view in FIG. 2 is an example of a downhole tool 10, and for the interest of brevity tool 10 is a representative example of one or more of downhole tools $\mathbf{10}_{1\text{-}n}$ of FIG. 1 and downhole tools $\mathbf{10}\mathrm{A}_{1\text{-}n}$ of FIG. 1A. An example of conditioning the downhole tool 10 is schematically depicted in FIG. 2. Tools $\mathbf{10}_{1\text{-}n}$, $\mathbf{10}\mathrm{A}_{1\text{-}n}$ are optionally conditioned as illustrated in FIG. 2 and in accordance with the following description. Non-limiting examples of conditioning the downhole tool 10 include one or more of: removing flowable foreign material from within the downhole tool 10, loosening solid or substantially solid foreign material disposed in the downhole tool 10, solubilizing or diluting foreign material in the downhole tool 10, lowering the freezing point of material in and around the downhole tool 10, buffering the downhole tool 10 from damaging pH levels, maintaining flowability of foreign material in the downhole tool 10, applying substances into the downhole tool 10 that counter degradation of the downhole tool 10 and any components within to mitigate deleterious effects or processes introduced by the material (i.e. lubricating, reducing corrosion, and removing/reducing scale), and applying substances into the downhole tool 10 that prevent or substantially prevent damage to the downhole tool 10 from exposure to the foreign material. A non-limiting example of foreign material includes anything entering and/or disposed in the downhole tool 10 during wellbore operations (FIG. 1). Furthermore, foreign material includes that which was unintentionally allowed in the downhole tool 10, such as from leakage, and also includes material purposefully directed into the downhole tool 10, such as but not limited to drilling fluid or wellbore fluid pumped through the inner bore 17 of the downhole tool. Wellbore fluid 18 and that contained within wellbore fluid 18 are examples of foreign material. Conditioning the downhole tool 10 includes conditioning of anything within or coupled to the downhole tool 10.

In the example of FIG. 2, a conditioning fluid 32 is illustrated being introduced into downhole tool 10. Depicted in this example is that downhole tool 10 includes an outer body 34 in which the conditioning fluid 32 is directed and retained. Optionally, an amount of conditioning fluid 32 introduced into the downhole tool 10 is such that all components and surfaces within the downhole tool 10 are in contact with the conditioning fluid 32. In a non-limiting example, conditioning fluid 32 purges wellbore fluid 18 and components within wellbore fluid 18 from within body 34. Alternative example functions of the conditioning fluid 32 include dissolving and/or solubilizing deposits that have formed on the downhole tool 10, and preventing formation of such deposits. Examples sources of deposits include wellbore fluid 18, formation material, oxidization, corrosion, galvanic interaction, foreign matter, and the like. Further, at least some of wellbore fluid 18 and components within wellbore fluid 18 not purged from within body 34 become entrained within conditioning fluid 32. In the illustrated example, conditioning fluid 32 is provided from a fluid supply system 36, which is schematically illustrated. Examples of conditioning fluid 32 include water, aqueous and hydrocarbon based solvents, a fracturing fluid, a completion fluid, a diluent, a solubilizing agent, an anti-scaling agent, a pH buffer, a liquid freezing point depressant, such as mono-ethylene glycol, ethylene glycol, antifreeze, corrosion inhibitors, antioxidants, biocides, surfactants, oxygen scavengers, detergents, and combinations thereof. In FIG. 2, arrows A reflect an example path of conditioning fluid 32 through body 34, and within a cavity 38 or inner bore defined inside of body 34. Components $\mathbf{40}_{1\text{-}3}$ are depicted within body 34, and schematically represent devices within downhole tool 10; and which are subject to contact with wellbore fluid 18 when tool 10 is within wellbore 12. In an example, wellbore fluid 18 is purposefully introduced into the downhole tool 10 and cavity 38, such as in the example of a mud motor, a pulser valve, a turbine, a probe, or a communication bus connector. Alternatively, wellbore fluid 18 seeps into the cavity 38 due to a pressure differential between the cavity 38 and pressure in wellbore 12. The types of devices represented by components $\mathbf{40}_{1\text{-}3}$ include those that are intended to remain stationary, those that are intended to be selectively moveable and sometimes stationary, such as a rotating part, and those that are intended to be continuously moving. Absent attempts to mitigate the presence of wellbore fluid 18 on or inside downhole tool 10 while stored and between deployments in the wellbore 12, one or more of components $\mathbf{40}_{1\text{-}3}$ is subject to contamination, corrosion, or binding that introduces a risk of failure of the components $\mathbf{40}_{1\text{-}3}$ during a subsequent deployment in a wellbore 12.

Fluid supply system 36 of FIG. 2 includes a storage tank 42 for retaining the conditioning fluid 32, and a feedline 44 that conveys the conditioning fluid 32 from storage tank 42 to a pump 46. In an alternative pump 46 connects directly to or is disposed within storage tank 42. Pump 46 is illustrated as a centrifugal pump, in alternate embodiments pump 46 is a positive displacement pump, a piston based pump; and examples of power modes include manual, electrical, or hydraulic. An inlet line 48 is shown having one end connected to pump 46 and an opposing end that terminates at a cap 50 shown releasably mounted to one end of body 34. Optionally, fluid 32 is gravity fed directly to tool 10, or storage tank 42 is pressurized to provide a force to drive fluid 32. An inlet fitting 52, which in an example is a quick connect/disconnect fitting, mounts onto an inlet port 54 shown formed through a sidewall of cap 50, and is shown providing connection between inlet line 48 and cap 50. In one alternative, inlet fitting 52 opens by attaching inlet line 48, which allows fluid communication between inlet line 48 and inlet port 54 through a passage (not shown) within inlet fitting 52. Similarly, fluid communication through inlet fitting 52 is terminated by disconnecting inlet line 48 from inlet fitting 52. In an embodiment, inlet fitting 52 includes a female fitting portion that selectively mounts onto inlet port 54 of cap 50, and a male fitting portion selectively mounted on inlet line 48. In alternative embodiments the female fitting portion selectively mounts onto inlet port 54 and the male fitting portion selectively mounts on inlet line 48. Example materials for the male and female fitting portions include metal, such as stainless steel, aluminum, Inconel®, alloys thereof, and combinations thereof. Alternatively materials for the male and female fitting portions include a robust synthetic material, such as polyetheretherketone ("PEEK"). In an alternative, the inlet port 54 is located on an outer surface of cap 50 and oriented substantially parallel to longitudinal axis $A_{10}$ of downhole tool 10 having a fluid channel (not shown) through inlet port 54 that is oriented substantially perpendicular to the longitudinal axis $A_{10}$. In another embodiment, inlet fitting 52 is mounted onto inlet port 54 and oriented substantially perpendicular to longitudinal axis $A_{10}$; which facilitates access to the inlet fitting 52, such as while directing fluid into port 54.

Embodiments exist in which inlet line 48 connects to the inlet fitting 52 by a shrink fit or a clamp. In an alternative embodiment inlet line 48 is connected directly to the inlet port 54 of cap 50. The inlet line 48 is optionally connected permanently (not removably) or removably. In an example the connection of inlet line 48 to cap 50 is a welded connection and inlet line 48 is made from metal. Alternatively, the inlet line 48 connects to cap 50 by a clamp (not shown) or by a threaded member (not shown) screwed to a thread formed in cap 50. Example materials for inlet line 48 include flexible or rigid material; such as but not limited to plastic, metal, rubber, fiber impregnated flexible material, and combinations. Inlet line 48 optionally includes a valve (not shown) to control the fluid flow from the storage tank 42 to the inlet port 54 of the cap; which in an example is controlled manually by a handle, electronically by a control button or processor.

Still referring to FIG. 2, the flow of fluid as illustrated by arrows A is in a direction away from cap 50 and along the length of cavity 38. An outlet port 56 is schematically illustrated formed through a sidewall of another cap 58 that releasably mounts on an end of body 34 opposite from cap 50. An example of an outlet fitting 60, similar to inlet fitting 52, is illustrated that provides fluid communication between outlet port 56 and an exit line 62, where exit line 62 is similar to inlet line 48; exit lie 62 is optionally a drainage hose. In one example, outlet fitting 60 is a quick disconnect and through which fluid communication is provided when connected to exit line 62 and fluid communication is block through outlet fitting 60 when exit line 62 is disconnected. Alternatives to connect exit line 62 to outlet port 56 exist that are similar to those of inlet line 48 and inlet port 54 as discussed above. In a non-limiting example, fluids, such as air and wellbore fluid residing in the downhole tool 10 are urged from within downhole tool 10 and through exit line 62 is response to forces applied from conditioning fluid 32 introduced into the downhole tool 10 through inlet port 54 into cavity 38. An optional collection container 63 is shown in FIG. 2, which in an example receives the fluids exiting the downhole tool 10. In the example of FIG. 2, communication between the cavity 38 and outside of the downhole tool 10 is through the ports 55, 56, as discussed in more detail below, selectively changing ports 54, 56 from open to closed configurations blocks communication between the cavity 38 and outside the downhole tool 10 and conditioning fluid 32 inside downhole tool 10 is trapped or retained within.

In embodiments cap 50 mounts to a first opening of the cavity 38 or inner bore of downhole tool 10 and cap 58 mounts to a second opening of the inner bore 19 of downhole tool 10. For the purposes of discussion herein, cap 50 is alternatively referred to as inlet cap and cap 58 is referred to as outlet cap. First opening and second openings are located respectfully on opposite elongate ends of downhole tool 10 shown intersected by and spaced apart along the longitudinal axis $A_{10}$ of downhole tool 10. In one embodiment, the outlet port 56 is located on an outer surface of cap 58 oriented substantially parallel to longitudinal axis $A_{10}$ of downhole tool 10 having a fluid channel through outlet port 56 that is oriented substantially perpendicular to the longitudinal axis $A_{10}$. The outlet fitting 60 mounted onto outlet port 56 optionally projects substantially perpendicular to longitudinal axis $A_{10}$, and that selectively provides the advantage of facilitating access to outlet fitting 60, such as when introducing conditioning fluid 32 into the downhole tool 10. In an alternative, fittings that are located in the caps and are used to remove fluids (wellbore fluid, conditioning fluid) from the tool (drainage) and that are oriented substantially perpendicular to the longitudinal axis $A_{10}$ facilitate removal of fluids from the downhole tool. In one example, outlet port 56 is located on an outer surface of cap 58 that is oriented substantially parallel to longitudinal axis $A_{10}$ and at a low point of the cavity 38 in the downhole tool 10 allowing easy and complete exit of any fluid inside the cavity 38. In alternatives, the fluid channel (not shown) through outlet port 56 and outlet fitting 60 is substantially parallel to the gravitational force.

In a non-limiting example of operation, cap 58 is a blind cap (blind plug) and without ports or passages therethrough, and that defines a seal along the associated opening to block communication between the cavity 34 and outside the downhole tool 10; and conditioning fluid 32 is introduced into downhole tool 10 through the inlet port 54 of cap 50. In this example, wellbore fluid 18 including entrained aggressive material, and trapped air remain in the cavity 38 when conditioning fluid 32 is enters cavity 38. Further in this example, conditioning fluid 32 enters cavity 38 via cap 50 and inlet port 54 is closed, such as by disconnecting inlet line 48 from the cap 50 by decoupling male and female portions from one another. In alternative embodiments inlet port 54 is closed by a port seal plug (not shown) when inlet line 48 is disconnected from inlet port 54. Further in this example, after closing inlet port 54 conditioning fluid 32 remains in the downhole tool 10 during further handling of the downhole tool 10, such as transportation or storage. Alternatives exist in which movement of downhole tool 10 during further handling generates perturbations in the conditioning fluid 32 such that the condition fluid 32 comes into contact with and saturates all or substantially all surface area inside cavity 38, or inner bore 19 within string 18 (FIG. 1). The perturbations also mix the conditioning fluid 32 with wellbore fluid 18 in cavity 38 to prevent and/or mitigate destructive processes initiated by aggressive material in the wellbore fluid 18. In one example of use of a blind cap to seal an opening of the cavity 38 in the downhole tool 10, a second port (not shown) is provided on cap 50; where second port selectively operates as an outlet port for fluids in the cavity 38 such as residual wellbore fluid 18 and air; embodiments exist where fluids exit outlet port prior to or at the same time conditioning fluid 32 is being added into downhole tool 10. Optionally, a second fitting is coupled with second port, embodiments of the second fitting include a quick connect fitting, and a vent hose is optionally connected to second fitting. The vent hose optionally includes a vent hose fitting configured complementary to second fitting and for coupling with second fitting.

In an example, and independent of what type of caps are mounted to the first and second opening of the inner bore 19, a blind cap or a cap including a fluid port, caps provide an advantage of preventing the inner bore from more unwanted material, such as but not limited to dirt, dust, rain, and metal splints, to enter during handling. Additional advantages of the caps is to protect the thread connections on both ends of the downhole tool 10. In one alternative, a pin connection is provided on one longitudinal end of the downhole tool 10, and a box connection is formed on an opposite longitudinal end. In this example, caps mounted on either longitudinal side of the downhole tool 10 protects the threaded pin and threaded box connection from being damaged during handling of the downhole tool 10 (transport, storage, staging for string assembly). In an alternative embodiment a lifting member is provided on at least one of the caps mounted to each longitudinal side of the downhole tool allowing to use the cap as a lifting sub.

In one embodiment, cap 50 and cap 58 are mounted on longitudinal ends of downhole tool 10 and engaged by downhole tool connections formed on the longitudinal ends of the downhole tool. In this example, a threaded pin connection is on one end (downhole end, bit end) of downhole tool 10, and a threaded box connection on the other end (uphole end, drill pipe end). Different types of threads are envisioned in this example. Caps 50, 58 of this embodiment have corresponding threads for attachment to the respective ends of the downhole tool 10. Examples of standardized thread types in the oil field include NC38 NC40 (drill pipe connection), in some instances there are company specific connections for each service company. In an example, a cap mounted to a NC38 box connection on the downhole tool 10 includes a NC38 pin connection, and similarly, a cap mounted to a NC38 pin connection on the downhole tool 10 has a NC38 box connection. Downhole tool connections optionally include communication bus connectors to contact to a communication bus in another downhole tool when connected to it, and that are alternatively modular connections. An NC38 connection is not a modular connection. Modular connections generally depend on the specific design of a downhole tool and often differ for different service companies, and unlike drill pipe connections a standard has not been fully established for modular connections. A Baker Hughes modular connection is for example a modular T2 connection. In alternative embodiments the caps are mounted to a longitudinal end of the downhole tool using alternative means, such as screws, a clamp, a dowel, or a strap. For that purpose separate threads are optionally formed on an outer surface of the downhole tool 10.

Figure 3A:
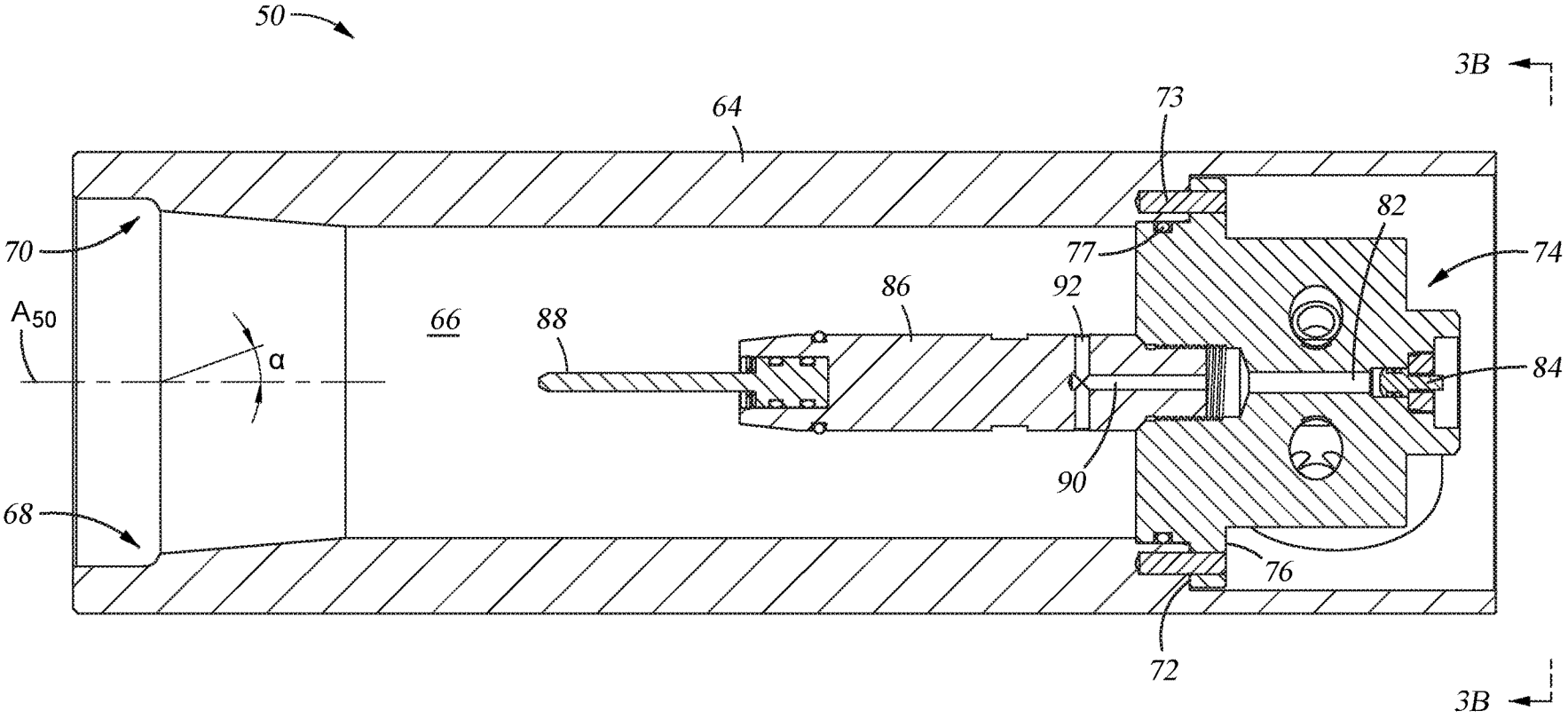
FIG. 3A is a side sectional view of an example of a cap having a box connection for attachment to the downhole tool of FIG. 2.

An example of cap 50 is shown in a side sectional view in FIG. 3A. Here, cap 50 is shown having an axis $A_{50}$ which extends along the length of cap 50. A cap housing 64 is defined along an outer periphery of cap 50 and shown circumscribing axis $A_{50}$. In the example shown, cap housing 64 is an annular member having a cylindrical overall shape; and in alternative embodiments cap housing 64 is a multi-sided member (such as triangular, squared, pentagonal hexagonal). Extending axially inside cap housing 64 is an open space that defines a bore 66. Bore 66 projects radially outward at a transition 68 shown proximate an end of cap housing 64 to define a box connection 70. Inside box connection 70 are threads formed along the inner surface of cap housing 64. Distal from box connection 70 bore 66 projects radially outward to define a shoulder 72, shown facing away from box connection 70. A manifold assembly 74 is inserted within bore 66 and adjacent shoulder 72. In the illustrated example, manifold assembly 74 is illustrated substantially concentric with axis $A_{50}$. Manifold assembly 74 is shown as a generally solid cylindrical member, and is alternatively a multi-sided member (such as triangular, squared, pentagonal hexagonal). An outer radius of manifold assembly 74 projects outward along a portion of its axial distance to define a flange 76 that is shown abutting shoulder 72. A portion of manifold assembly on a side of flange 76 facing transition 68 projects axially past shoulder 72 and inserts into bore 66. An O-ring 77 provides a sealing interface between manifold assembly 74 and bore 66. Fasteners 73 secure manifold assembly 74 to cap housing 64, and which in one example extend axially through flange 76 and into shoulder 72. Examples of fastener include a screw, dowels, a threaded connection on the inner surface of the cap housing 64 housing and a thread on an outer surface of the manifold, a clamp, a press fit, or in an alternative the manifold is permanently affixed to the cap housing 64 such as by welding or gluing. Example materials for the manifold 74 and the cap housing 64 include metals, such as stainless steel, aluminum, or Inconel®, alloys thereof, and combinations thereof; and also include robust synthetic materials such as PEEK. Advantages exist by minimizing cap mass so that the downhole tool 10 does not become unwieldy during transportation. In an example, manifold 74 is made from a lower density material such as aluminum. Optionally, material for cap housing 64 is stainless steel, which has properties that resist damages during tool handling (collisions while tool movement). Example mass for a fully assembly cap 50, 58 ranges from about 8 kg to about 15 kg. It is to be noted that mass of the downhole tool 10 also increases due to the conditioning fluid filled into the tool during the conditioning procedure. Examples volumes of inner bore 19 and/or cavity 38 range from about 8 liters to about 20 liters (depending on downhole tool size), so that in this example filling a downhole tool 10 with conditioning fluid 32 increases the overall mass by about 8 kg to about 20 kg. Further in this example, the total mass gain due to the connected caps 50, 58 and the conditioning fluid 32 ranges from about 24 kg to about 50 kg. For an example mass of downhole tool 10 without cap 50, 58 or conditioning fluid 32 being about 500 kg, the mass increase corresponds to percentage mass increase of about 5% to about 10% of the downhole tool 10. For a downhole tool mass of 1000 kg the percentage of mass increase corresponds to about 2.5% to about 5%. In embodiments the manifold 74 includes a fixing member (not shown) that is used to mount the cap 50, 58 to the downhole tool 10 (e.g. multi-side profile, such as a hexagon profile). In this example the manifold 74 is made from metal to accommodate torque transfer; which in an example ranges from about 150 Nm to about 250 Nm, or from about 100 Nm to about 300 Nm. In an alternative cap 50, 58 is torqued to the downhole tool 10 by engaging recesses in the outer surface of cap housing 64, such as with a torque tool (not shown). Having manifold and cap housing detachable allows an advantage of using one size manifold with different sizes of cap housings. In an embodiment, the cap housing diameter depends on the diameter of the downhole tool, and one manifold size is useable with all downhole tool sizes.

A passage 82 is illustrated in the example of FIG. 3A shown extending axially through manifold assembly 74 and along axis $A_{50}$. A diameter of passage 82 increases proximate an end of manifold assembly 74 facing away from bore 66, and in which a pressure relief member 84 is installed for preventing overpressure of tool body 34 (FIG. 2). In alternative embodiments the pressure relief member 84 is mounted outside of passage 82. An example diameter of passage 82 ranges from about 2 mm to about 5 mm, and optionally is increased to create a seat for pressure relief member 84 to range from about 11 mm to about 50 mm. Examples of the pressure relief member 84 include a pressure plug opening at a predefined pressure, or a pressure relief valve configured to a threshold pressure at which the valve opens and releases pressure; and alternatively is a passive device or an electronically controlled device, and optionally is a one-use device or a re-usable device. The pressure relief member 84 is alternatively made from metal or a robust plastic material. In an example, the threshold pressure at which the pressure relief member releases pressure is about 6 bar to about 8 bar, or about 5 bar to about 9 bar, or about 4 bar to about 10 bar. Options for mounting the pressure relief member 84 to manifold 74 include a threaded connection or press fitting. In a non-limiting example, fluid communication through passage 82 is blocked by pressure relief member 84 up until a designated pressure; at which then pressure relief member 84 opens to allow fluid communication through passage 82. An example of a communication bus seal member includes an elongated insert 86 having an end engaged with an enlarged portion of passage 82 facing box connection 70. An end of insert 86 distal from manifold assembly 74 is fitted with a connector prong 88. In the illustrated example, connector prong 88 is an elongate member having a free end profiled to engage a receptacle 89 (FIG. 2) when cap 50 is mounted to downhole tool 10; engaging connector prong 88 with receptacle 89 blocks entry of conditioning fluid 32 into receptacle 89. In an example, receptacle 89 is a female communication bus connector in the downhole tool 10. In the illustrated example, receptacle 89 is a communication bus connector in downhole tool 10, here formed as a central connector located within the inner bore 19 of the downhole tool. In alternative embodiments the communication bus connector is another type of connector, such as a ring or partial ring connector in the shoulder of pin or box downhole tool connection. Alternatively, the communication bus connector is a pin connector (male/female) in the shoulder of the pin or box connection. The communication bus is optionally an electrical bus or an optical bus. In yet another embodiment the communication bus is connected wirelessly by one of an inductive connection and/or capacitive connection, and magnetic resonance coupling. The receptacle 89 optionally provides an electrical contact, an optical contact, or a wireless communication means to the communication bus of the downhole tool 10. In the alternative embodiments insert 86 and receptacle 89 are formed according to the shape of the alternative communication bus connectors in the downhole tool 10, such as for example ring shaped. Insert 86 and receptacle 89 are configured to seal the respective communication bus system connector in the downhole tool connection to avoid contact of the communication bus connector with the conditioning fluid 32 filled inside the downhole tool 10. The connector prong 88 is optionally made from metal or plastic material.

In an alternative embodiment connector prong 88 is made from a conductive material, and is part of an inner cap communication bus connector providing an electrical contact (contact connector prong) when engaging with receptacle 89. In an example, connector prong 88 is connected to an electrical line (not shown) at the end opposite to its free end. Electrical line of this example is extending inside a wire channel (not shown) inside insert 86 and through manifold assembly 74 to an axial end of manifold assembly away from bore 66. The electrical line is terminated in an outer cap communication bus connector (not shown) located in manifold assembly 74. The electrical connector allows access to the communication bus of downhole tool 10 while the cap 50 is mounted to the downhole tool 10, covering the communication bus connector in the downhole tool. An advantage of the option of connecting to the communication line while cap 50 is mounted to the downhole tool 10 enables for dumping data, calibrating sensors in the tool, performing function tests of the tool, and programming the tool for a subsequent deployment. Alternatively, contact connector prong includes an optical connector and is connected to an optical fiber. Another embodiment includes a connector providing a wireless communication with the communication bus in the downhole tool 10.

Figure 3B:
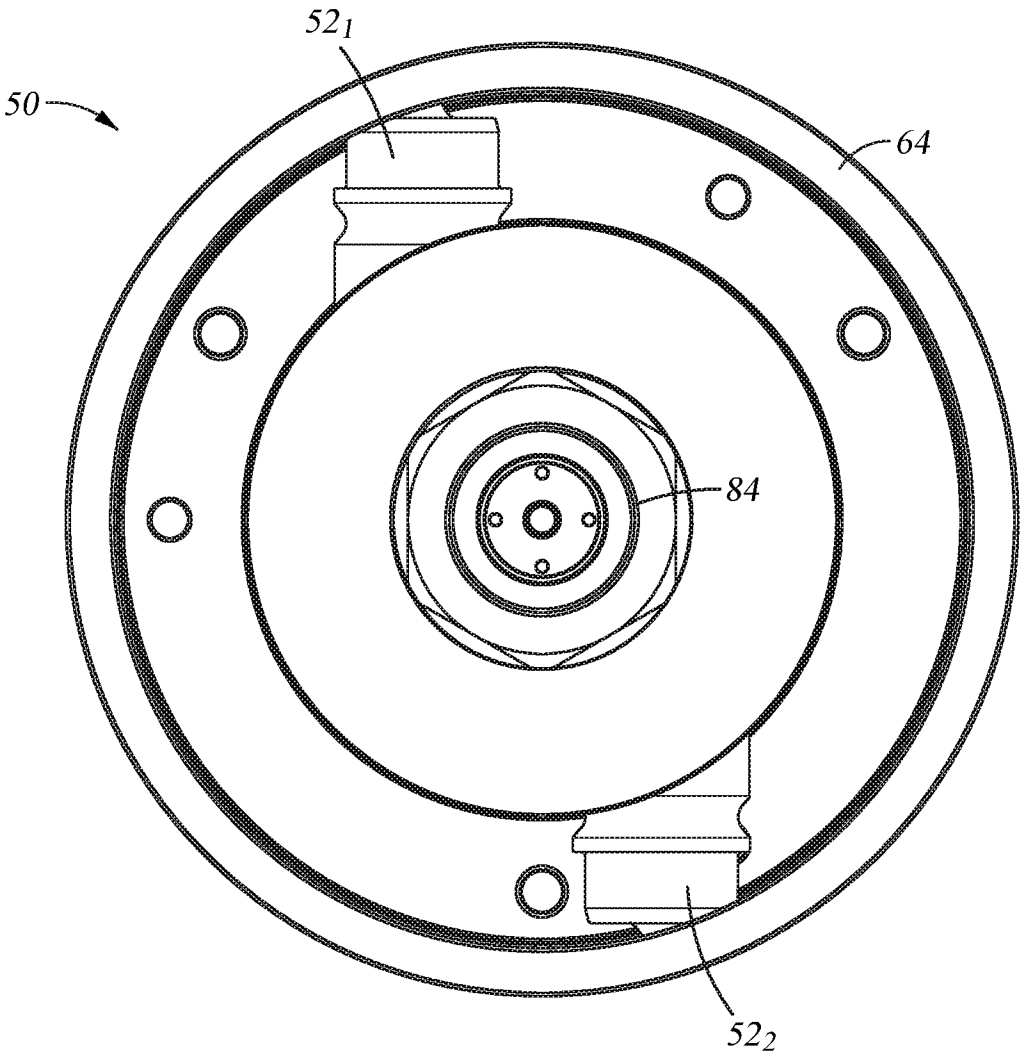
FIGS. 3B and 3C are end and perspective views respectively of the cap of FIG. 3A.
Figure 3C:
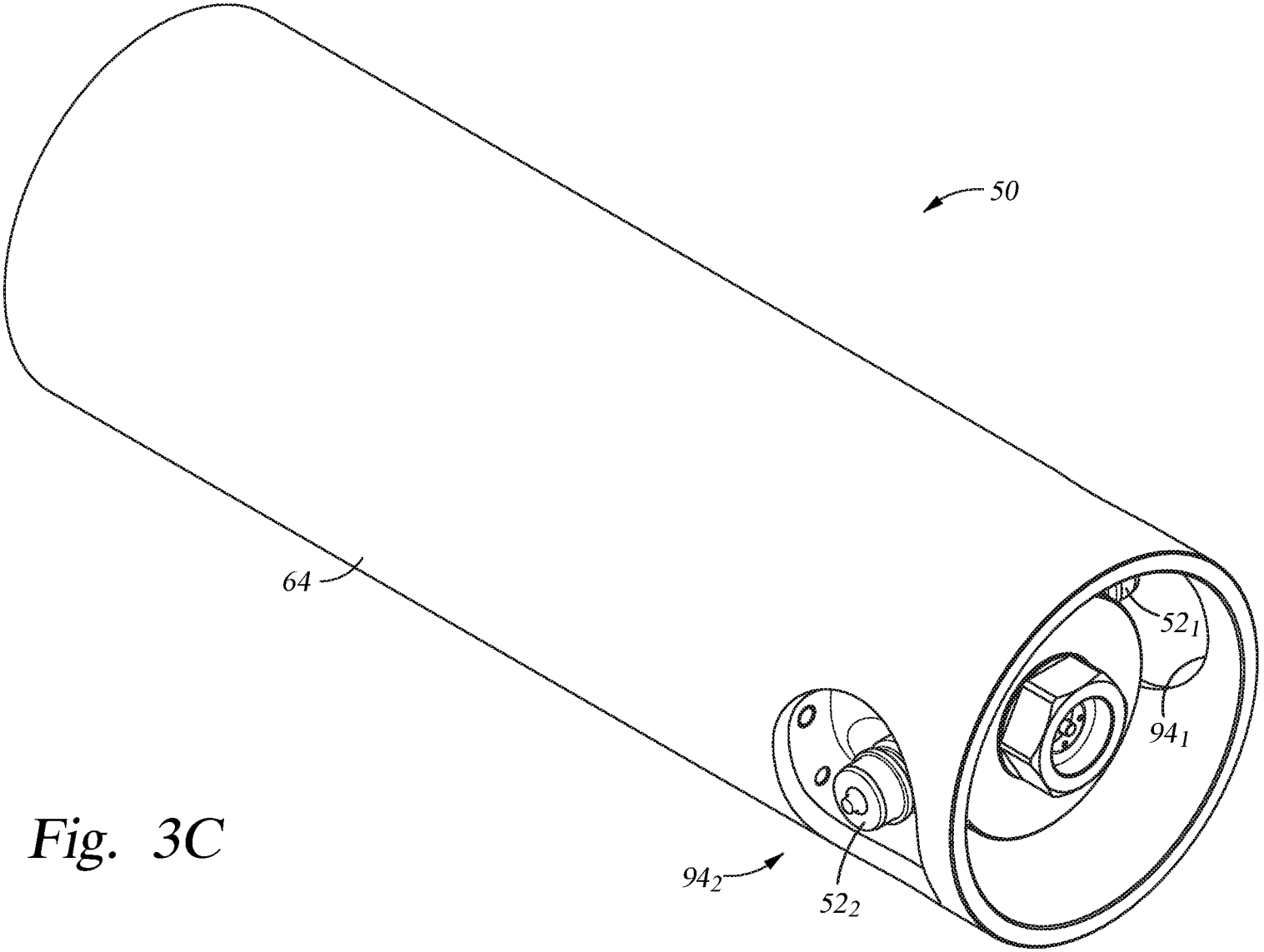

A passage 90 is shown extending axially through an end of insert 86 within passage 82 and is in communication with passage 82. Leads 92 are illustrated within insert 86 that project radially outward from passage 90 and through an outer surface of insert 86 to provide communication between passage 90 and bore 66. Alternative orientations of lead 92 are possible (angled lead or parallel lead with respect to axis $A_{50}$). As will be described in more detail below, conditioning fluid 32 supplied to the manifold assembly 74 is directed through passages 82, 90, then to leads 92 and for introduction into downhole tool 10 via bore 66. In an alternative, lead 92 has a diameter strategically sized to define a barrier to block entry of particles into lead 92 and passages 90 and 82; and acts as a screen to prevent plugging of passages 82 and 90. An end view of cap 50 is shown in FIG. 3B and which is taken along lines 3B-3B of FIG. 3A. In the example of FIG. 3B, a pair of fittings $\mathbf{52}_{1,2}$ connect to, and project radially outward from, the outer radius of manifold assembly 74. Adding multiple inlet fittings $\mathbf{52}_{1,2}$ provides the advantage of improved accessibility for adding conditioning fluid 32 to the cap 50. In FIG. 3C a perspective view is illustrative of cap 50 and depicts cap housing 64 as a generally cylindrical member. Further illustrated in FIG. 3C are openings $\mathbf{94}_{1,2}$ formed through the sidewall of cap housing 64 and each extend partially along a circumference of the cap housing 64 to provide access to fittings $\mathbf{52}_{1,2}$. As noted above, multiple inlet fittings $\mathbf{52}_{1,2}$ are not required to perform the conditioning procedure or to use cap 50, one inlet fitting 52 is sufficient and which would correspondingly result in a single opening 94. Cap housing 64 as shown provides a seat for manifold 74 and is configured to protect manifold 74 from damages during handling. As discussed above, applying and connecting inlet line 48 of FIG. 2 with either inlet fittings $\mathbf{52}_{1,2}$ opens fluid communication across the particular fitting so that fluid is then introduced into cap 50 for flow into the downhole tool 10 (FIG. 2). In one example cap housing 64 and manifold 74 are two main parts of cap 50. In an alternative embodiment cap housing 64 is split into two portions with a manifold host portion 65 and a protection ring portion 67 having the at least one opening 94 (both not separately indicated in FIG. 2). In this example, at least one opening 94 is formed in an axially outermost portion of cap 50, and is exposed to damages during handling of the downhole tool 10. Having the opening 94 in a separate protection ring portion provides easy replacement of the protection ring portion 67 of the cap housing 64 should it become deformed or damaged by impacts encountered during handling. The protection ring portion is optionally mounted on the manifold host portion 65 of cap housing 64 by a protection ring fixation member 69, such as a screw at an outer surface of protection ring portion 67 by a clamp, or by a thread on the circumference of outer or inner surface of the manifold portion and the circumference on an outer or inner surface of the protection ring portion 67.

Figure 4A:
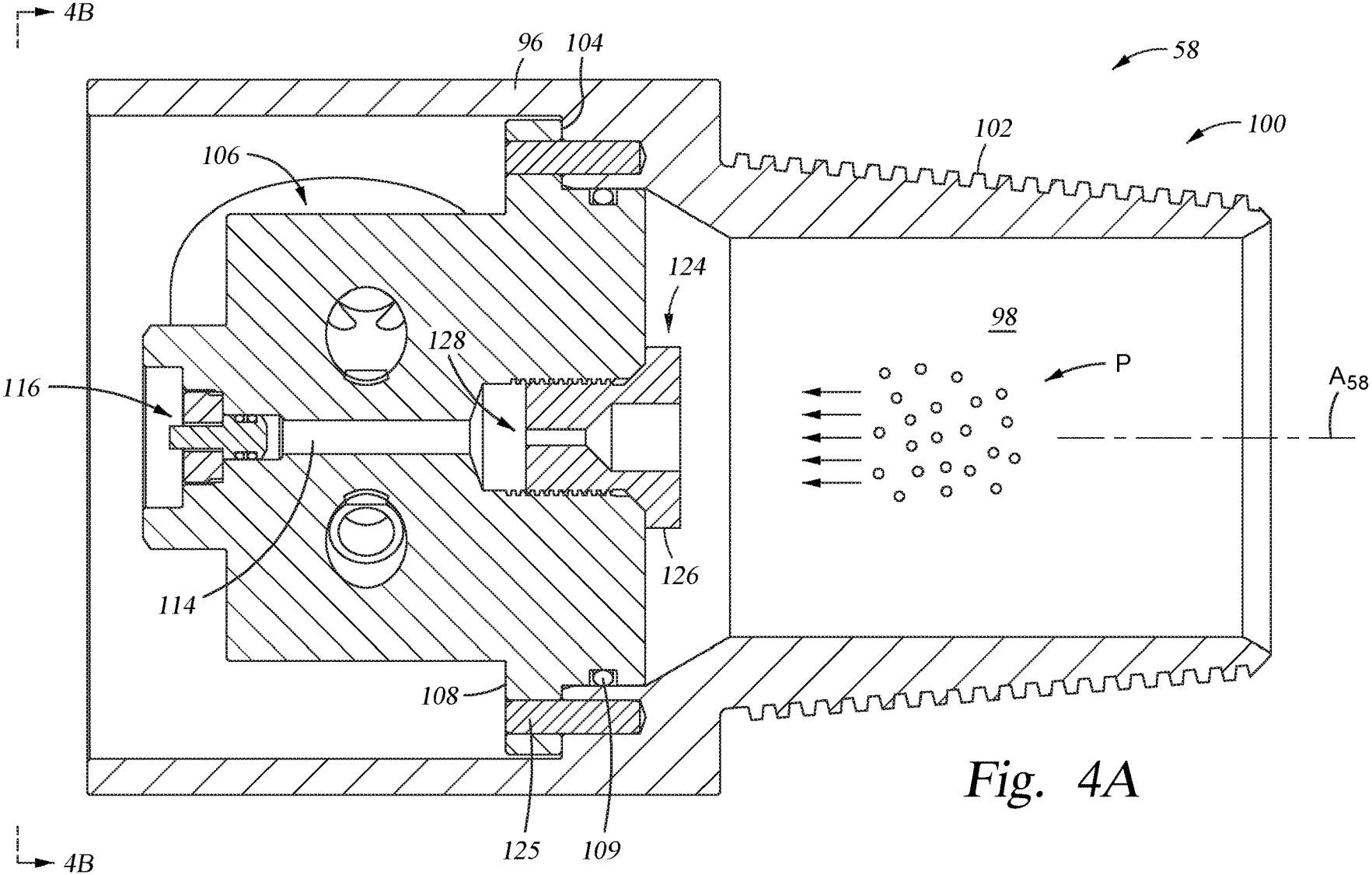
FIG. 4A is a side sectional view of an example of a cap having a pin connection for attachment to the downhole tool of FIG. 2, and FIGS. 4B and 4C are end and perspective views respectively of the cap of FIG. 4A.

Referring now to FIG. 4A, an example of cap 58 is shown in a side sectional view. Cap 58 in this example includes a cap housing 96 having a bore 98 within that extends along the axis $A_{58}$ of cap 58. Included with cap 58 are components the same or similar to those included with cap 50 discussed above. An outer radius of cap housing 96 reduces at a point and defines a pin connection 100 on one end of cap 58. Threads 102 are formed on an outer surface of pin connection 100. A shoulder 104 is formed within housing 96 where a radius of bore 98 abruptly changes. Shoulder 104 is spaced axially from pin connection 100, and faces in a direction away from pin connection 100 to provide a seat on which a manifold assembly 106 is secured. A portion of an axial length of manifold assembly 106 projects radially outward to define a flange 108. In the illustrated example flange 108 abuts shoulder 104, and a portion of manifold assembly 106 adjacent flange 108 projects axially past shoulder 104 towards pin connection 100. An O-ring 109 circumscribes the portion of the manifold assembly 106 extending past the shoulder 104, and a sealing interface is formed between the housing 96 and manifold assembly 106. Further in the example of FIG. 4A, a fastener 125 secures manifold assembly 106 within housing 96. An axial passage 114 is shown extending through manifold assembly 106 and substantially coincident with axis $A_{58}$. A pressure plug 116 for preventing overpressure of housing 32 (FIG. 2), is shown mounted within passage 114 and in an end opposite from pin assembly 100. Fluid communication through passage 114 is blocked by pressure plug 116 up until a designated pressure differential across plug 116; at which then pressure plug 116 opens to allow fluid communication through passage 114.

Figure 4B:
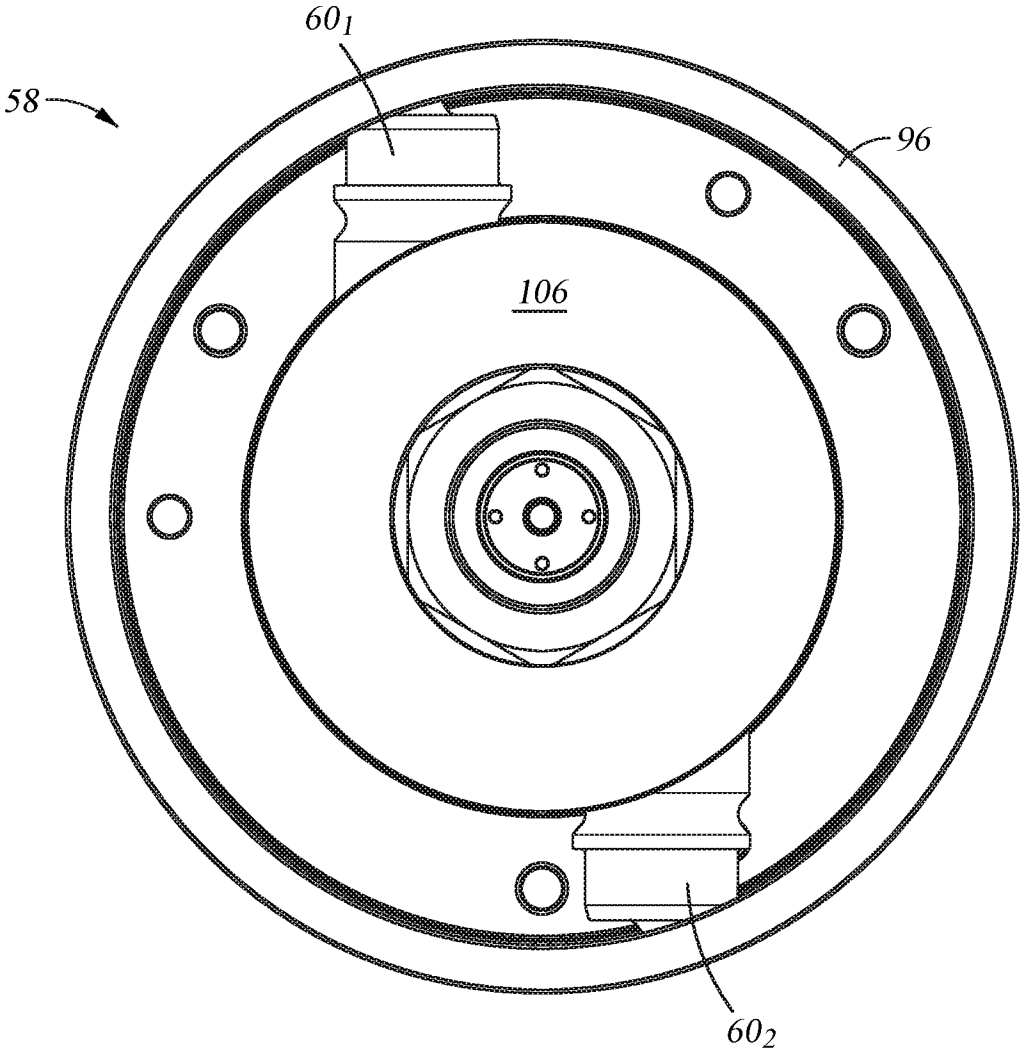

An end view of cap 58 is shown in FIG. 4B and which illustrates fittings $60_{1,2}$ mounted onto manifold assembly 106 and projecting in different directions. As with cap 50 of FIGS. 3A through 3C, multiple fittings $60_{1,2}$ provide for access to fluid communication within cap 58 irrespective of the orientation of tool 10. Multiple fittings $60_{1,2}$ are not required to perform the conditioning procedure or to use cap 58. Having fittings $60_{1,2}$ and corresponding outlet ports $56_{1,2}$ being located on the outer radius of manifold assembly cap 50 projecting radially outward provides a fluid channel parallel to the gravitational force at a low point of the bore 98, provided that the downhole tool 10 is oriented respectively. In a non-limiting example of use, the downhole tool 10 is oriented so that axis $A_{10}$ is substantially horizontal when being filled with conditioning fluid 32. Alternatively, an end of the downhole tool 10 is elevated to facilitate filling or drainage. Radially locating fittings $60_{1,2}$ facilitates removal of the conditioning fluid 32 and entrained aggressive material from the downhole tool 10 prior to the next usage. In the perspective view of FIG. 4C, openings $118_{1,2}$ are shown formed through a sidewall of housing 96 and which provide external access to fittings $60_{1,2}$. Openings $118_{1,2}$ are spaced axially away from a terminal end of housing 94, and each extend along a portion of the circumference of housing 94. Alternatively, a single opening is formed through housing 94, such as in embodiments having a single fitting 60, which is adjacent to fitting 60. Similar to inlet cap 50, embodiments of outlet cap 58 exist having a manifold host portion and protection ring portion.

Figure 4C:
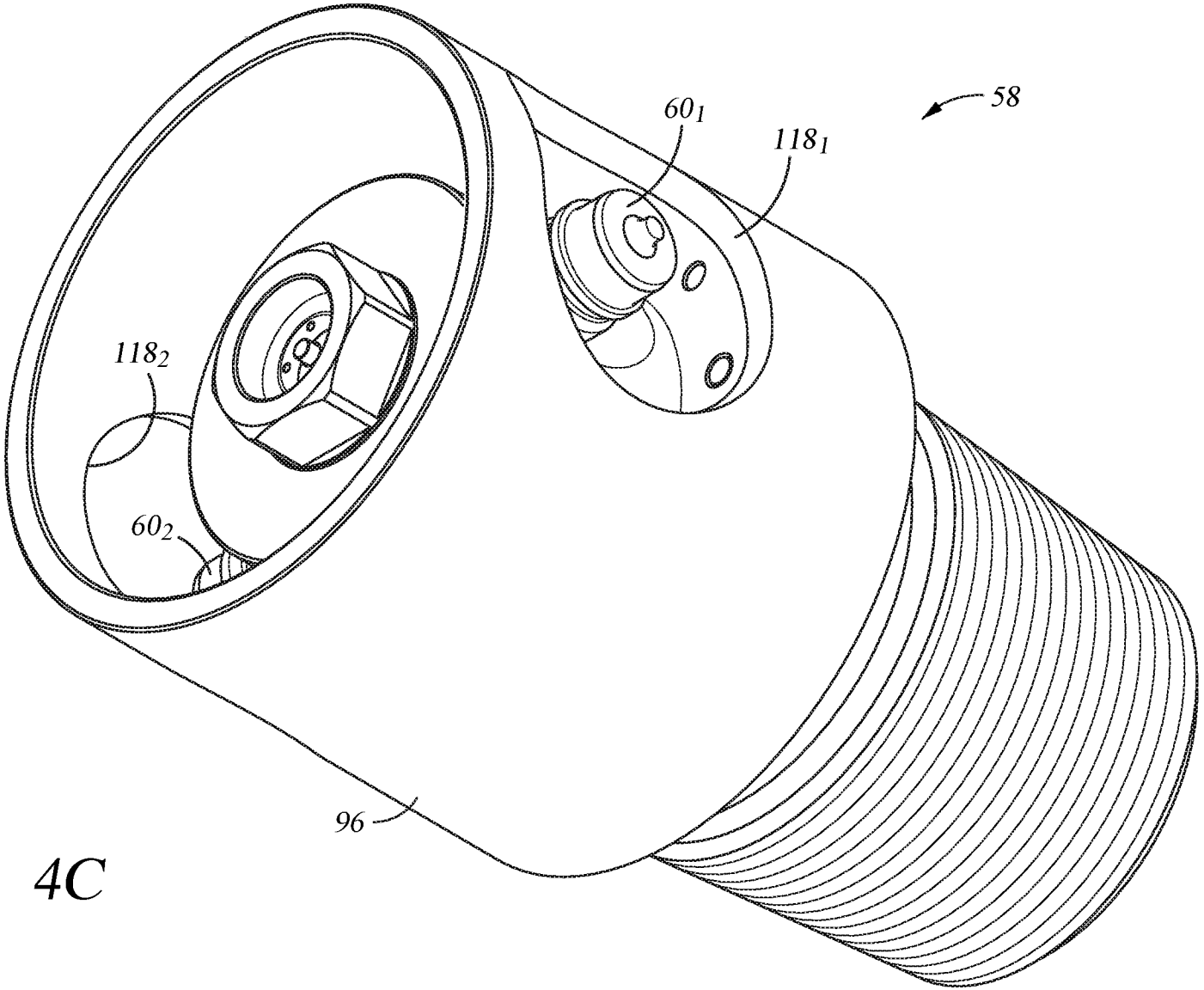
Figure 5A:
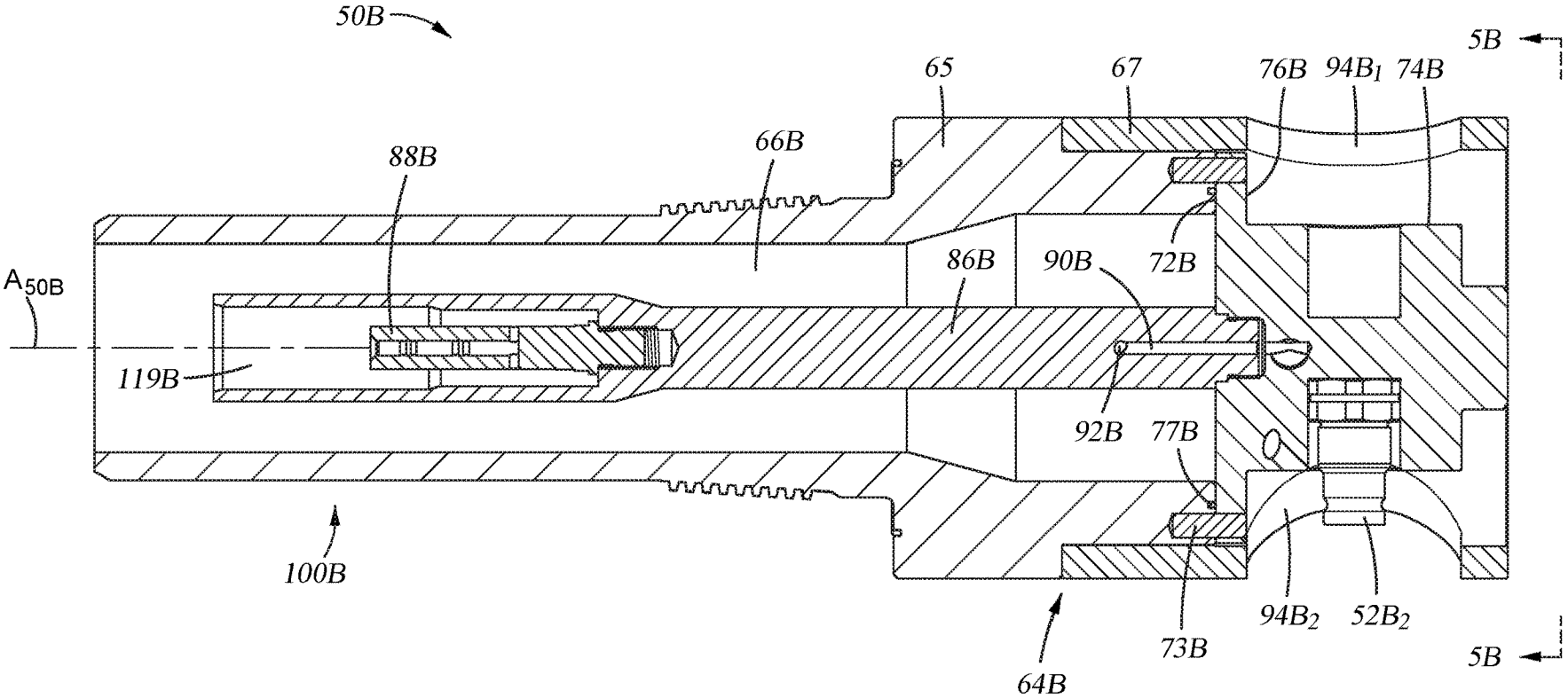
FIG. 5A is a side sectional view of an example of an alternate embodiment of a cap having a pin connection for attachment to the downhole tool of FIG. 2, and FIGS. 5B and 5C are end and perspective views respectively of the cap of FIG. 5A.
Figure 5B:
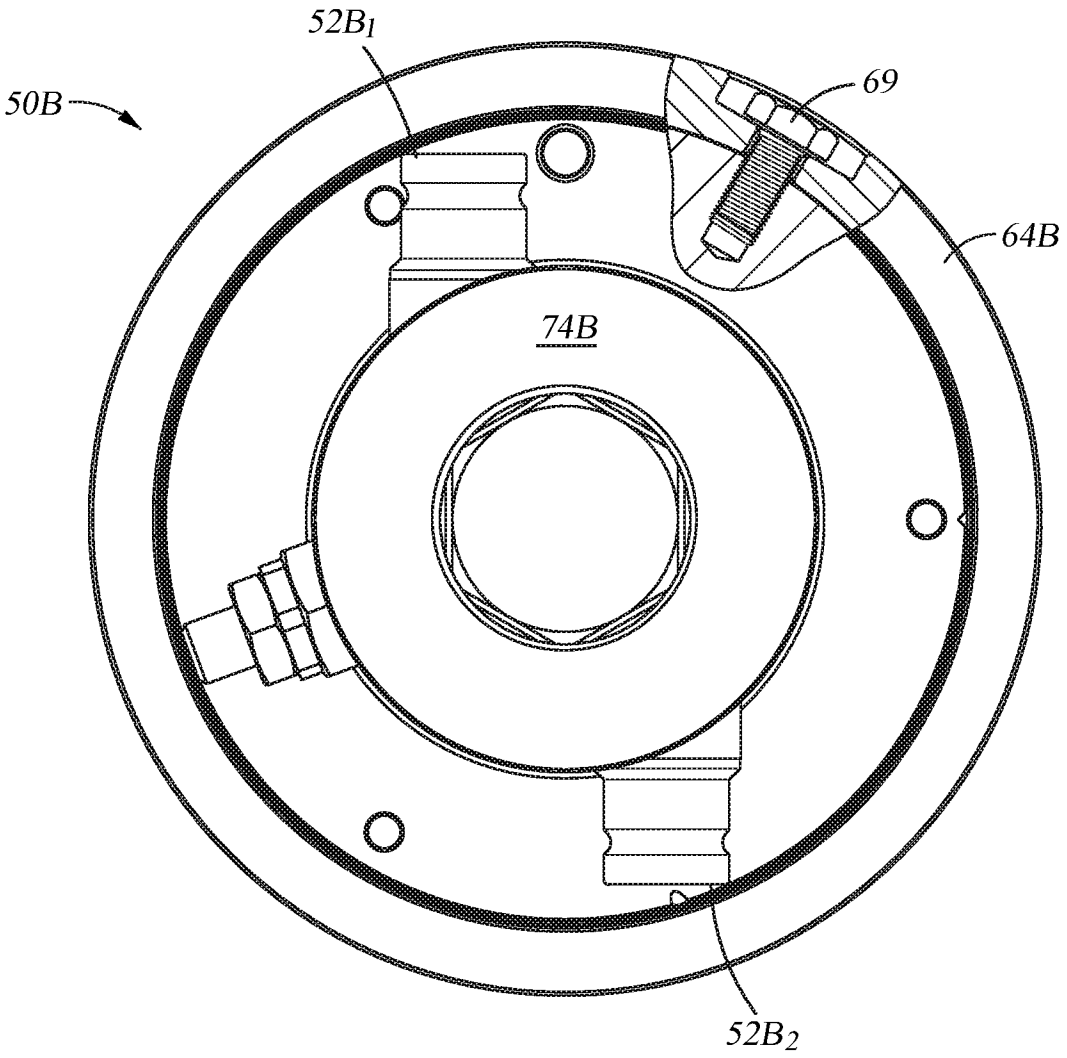
Figure 5C:
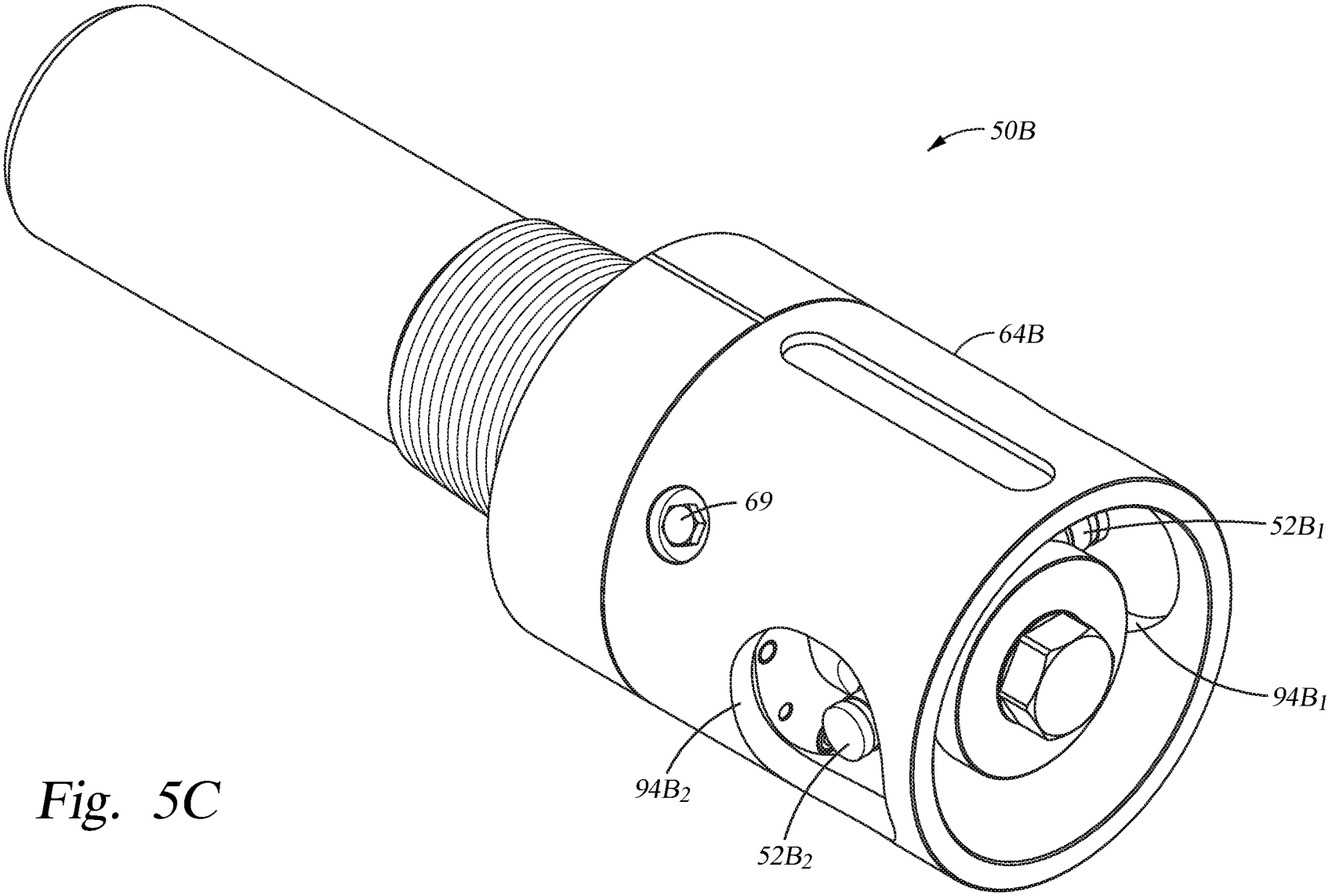

Illustrated in FIGS. 5A-5C is an alternate example of a cap 50B having features similar to cap 50 of FIGS. 3A-3C and cap 58 of FIGS. 4A 4C. In the example shown, an outer radius of cap housing 64B reduces at a point and defines a pin connection 100B on one end of cap 50B; and an O-ring 77B provides a sealing interface between manifold assembly 74B and bore 66B. Fasteners 73B secure manifold assembly 74B to cap housing 64B, and which in one example extends axially through flange 76B and into shoulder 72B. As shown in side sectional view in FIG. 5A, insert 86B projects axially along axis $A_{50B}$ inside housing 64B. An end of insert 86B mounts to manifold assembly 74B, and passage 90B inside insert 86B is in fluid communication with fitting $52B_2$ via channels (not shown) formed through manifold assembly 74B. Communication between passage 90B and chamber 66B is through lead 92B that is formed radially through insert 86B; alternatively, multiple leads 92B are formed in insert 86B. In the example of FIG. 5A, connector prong 88B is a female type connection and configured to receive a male communication bus connector similar to the connection prong 88 of FIG. 3A. As shown, connector prong 88B is disposed within a bore 119B that extends axially inside insert 86A and along axis $A_{50B}$. Bore 119B intersects an end of insert 86B distal from manifold assembly 74B to form an opening in which connection prong 88B is received. An end view of cap 50B is shown in FIG. 5B and taken along lines 5B-5B of FIG. 5A and illustrating inserts $52B_{1,2}$ projecting radially outward from manifold assembly 74B and where housing 64B circumscribes manifold assembly 74B. Shown in perspective view in FIG. 5C are openings $94B_{1,2}$ formed radially through spaced apart portions of housing 64B, and which allow access to $52B_{1,2}$.

As shown in FIGS. 3A-3C and 4A-4C inlet fitting 52 and outlet fitting 60 project radially outward providing a fluid channel substantially parallel to the gravitational force. In an alternate embodiment inlet fitting 52 and/or outlet fitting 60 are oriented substantially parallel to downhole tool axis $A_{50}$, providing a fluid channel substantially parallel to axis $A_{50}$. Alternatively, inlet fitting 52 and/or outlet fitting 60 may be oriented at an angle $\alpha$ to axis $A_{50}$, providing a fluid channel having an angle to axis $A_{50}$. In these alternative embodiments inlet fitting 52 and outlet fitting 60 are mounted to the cap and/or the manifold at an angle (not shown). Example ranges of angle $\alpha$ include from about 1 degree to about 89 degrees, from about 45 degrees to about 89 degrees, from about 1 degree to about 45 degrees, from about 80 degrees to about 89 degrees, from about 1 degree to about 10 degrees, from about 11 degrees to about 79 degrees, and all values between.

In one example of operation, downhole string 8 (FIG. 1) is removed from wellbore 12, after which downhole tools $10_{1-n}$ were used for wellbore operations. In this example, downhole tools $10_{1-n}$, either purposefully or through seepage, contain an amount of wellbore fluid 18 within after being removed from wellbore 12. Optional locations for conditioning of one or more of downhole tools $10_{1-n}$ include at a rig site or in a workshop, and during which one or more of downhole tools $10_{1-n}$ is set on the ground, a pipe deck (not shown), in a rack, a truck, or on stands, and conditioning fluid 32 is introduced into the one or more of the downhole tools $10_{1-n}$. Alternatives exist that in any location in which one or more of the downhole tools $10_{1-n}$ are accessible provides an adequate place for mounting the caps 50, 58 to the tool 10 and filling the conditioning fluid 32; which includes orientations when one or more of the downhole tools $10_{1-n}$ are oriented horizontally or vertically with respect to the Earth's surface. Generally, any orientation of one or more of the downhole tools $10_{1-n}$ are allows for adding the conditioning fluid 32. It should be pointed out that embodiments exist that when filling the downhole tool with conditioning fluid, the downhole tool 10 is not connected to the derrick; but the downhole tool is outside the borehole and disconnected from the downhole string, and not connected to a mud circulation system of the rig. In the example of FIG. 2, after a downhole tool 10 is removed from downhole string 8, caps 50, 58 are mounted to opposing ends of body 34 of downhole tool 10. Caps 50, 58 provide a way of introducing conditioning fluid 32 into the downhole tool 10, as well as flushing and removing wellbore fluid 18 from within downhole tool 10. Wellbore fluids, such as drilling fluid and other treatment fluids, often contain precipitates or other solids that potentially form deposits when the liquid component of the fluid is allowed to evaporate or drain; which is prone to leave a solid deposit that potentially binds together different moving parts of components $40_{1-3}$ within downhole tool 10. Further, some fluids or components of fluids within wellbore 12 are corrosive and that create corrosion and stress corrosion cracking within materials exposed to such fluid. In an example, wellbore fluid 18 is flushed from within downhole tool 10 to remediate the fluid(s) and components within. In an embodiment, conditioning fluid 38 is secured and/or retained within tool 10 to dissolve the deposits, and the secured and/or retained conditioning fluid 38, with entrained wellbore fluid 18 and/or components of wellbore fluid, is drained and/or flushed from within tool 10. In an alternative, the downhole tool 10 is being drained while at the same time conditioning fluid 32 is being added to the downhole tool 10. In one example, after adding a designated amount of conditioning fluid 32 into the downhole tool 10, lines 48, 62 are removed from the fittings 52, 60 on caps 50, 58. In examples when the fittings 52, 60 are quick disconnect types, ports 54, 56 are changed from open to closed configurations upon removing the lines 48, 62. In an alternative, fittings 52, 60 include valves for changing the ports 54, 56 between open and closed configurations; in this alternative valves are actuated to put ports 54, 56 into closed configurations. Further in this example, the downhole tool is transported or stored with caps 50 and 58 mounted to the downhole tool 10 and fluids trapped within. An advantage provided by trapping fluids inside the downhole tool 10 is that during the transportation and/or storage period destructive processes inside the downhole tool 10 due to aggressive material are prevented or mitigated due to the properties of the conditioning fluid 32. The conditioning fluid 32 is optionally removed from the downhole tool 10 upon or prior to reuse or maintenance of the downhole tool 10; alternatives for removing the conditioning fluid 32 include changing one or both ports 54, 56 into the open configuration and draining the conditioning fluid 32 out through an associated line 48, 62, and disconnecting at least one of the caps 50, 58 from the downhole tool 10. For the purposes of discussion herein, fluid that enters downhole tool 10 as conditioning fluid 32 and is then drained or flushed from within downhole tool 10 is referred to as discharge fluid 120; which is schematically illustrated in FIG. 2 flowing from a discharge end 122 of exit line 62 at a point in time after wellbore fluid 18 is shown flowing from the discharge end 122. Examples exist in which conditioning fluid 32 and wellbore fluid 18 combine to form a mixture M. Embodiments exist where the time for securing and/or retaining the conditioning fluid 32 is up to an hour, up to a day, up to a week, up to a month, up to a year, times greater than a year, and any time within these limits. An advantage of the system described herein, is that the conditioning fluid 32 is sealed within tool 10 and so that all or at least a portion of material from wellbore fluid 18 within tool 10 is put into close contact with the conditioning fluid 32 to cause the material to become entrained or otherwise associated with conditioning fluid 32; and when the conditioning fluid 32 is removed from within tool 10 by draining or flushing, wellbore fluid 18 and/or or components of the wellbore fluid 18 entrained within the conditioning fluid 32 is also removed from within the tool 10. In a non-limiting example draining conditioning fluid 32 from downhole tool 10 also removes the entrained wellbore fluid 18 and components from within downhole tool 10. Wellbore fluid 18 and/or discharge fluid 120 is optionally collected in a collection container 63 (FIG. 2).

Referring back to FIG. 4A, particles P are illustrated flowing within bore 98 and towards manifold assembly 106. Examples exist in which the particles P are suspended in one or more of the downhole fluid 18, mixture M, or conditioning fluid 32 (FIG. 2). A screen member, such as an optional plug filter 124 is shown mounted connected to passage 114 proximate bore 98. Plug filter 124 includes an annular base member 126 shown coupled to sidewalls of passage 114, example coupling means include threads, a press fit, a snap ring, a Seeger ring, a C ring, and similar techniques. An aperture 128 is shown formed axially through base member 126, which in an example is strategically sized to define a barrier to block entry of the particles P into passage 114 from bore 98. Example diameters of aperture 128 range from about 2 mm to about 5 mm. Alternatively, a screen, or a mesh (not shown) is mounted in passage 114, or the base member 126 is equipped with multiple apertures 128. In inlet cap 50 the aperture used as a particle barrier is included in lead 92 (FIG. 3A).

Examples of other caps used in oilfield applications include lifting caps for handling tools downhole or on a derrick, connection caps to connect downhole tools to fluid loop systems like a flow loop or a drilling fluid circulation system at the rig site (swivels), flushing caps to connect a downhole tool to a flushing system in order to clean a downhole tool, protection caps to protect threaded connections at the downhole tool, electrical connection caps that connect to a communication bus inside a downhole tool. Caps 50, 58 are distinguishable from at least some of these other caps as none have a closed cavity inside of the downhole tool, which receives a conditioning fluid through the caps. Caps 50, 58 allow containing the conditioning fluid 32 in the cavity 38 inside the tool 10 during transportation or storage until the next deployment for the purpose of preventing degradation of tool inner surfaces or jamming of moving parts by aggressive and solidifying wellbore fluid deposits.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. Example alternatives include cap 50 is a pin type connection, cap 58 is a box type connection, fluid is discharged or drained from downhole tool 10 through cap 50, fluid is added to downhole tool 10 through cap 58, and combinations thereof. In another alternative, all elements in the manifold assembly 74, such as fittings, pressure plug, connector seal, inner connector and outer connector are included with cap housings 64, 96. These and other similar modifications will readily suggest themselves to those skilled in the art, and are intended to be encompassed within the spirit of the present invention disclosed herein and the scope of the appended claims.

What is claimed is:

1. A method of treating a downhole tool used in a wellbore comprising:
securing a first cap to a first opening in the downhole tool to seal the first opening;
securing a second cap to a second opening in the downhole tool to seal the second opening;
introducing a fluid into the downhole tool through an inlet port in the first cap; and
retaining the fluid inside the downhole tool.

2. The method of claim 1, wherein the steps of introducing and retaining the fluid inside the downhole tool mitigate a destructive process due to a wellbore fluid having entered into the downhole tool when in the wellbore.

3. The method of claim 2, wherein the wellbore fluid comprises an aggressive material selected from the group consisting of components of a drilling fluid and a formation material.

4. The method of claim 2, wherein to mitigate a destructive process comprises one of lubricating, reducing corrosion, and reducing scaling.

5. The method of claim 1, wherein the downhole tool is a drilling tool and comprises an inner bore, and wherein the first opening and the second opening connect to the inner bore.

6. The method of claim 1, wherein the step of introducing comprises flowing the fluid into the downhole tool through the inlet port in the first cap.

7. The method of claim 1, further comprising draining the fluid from the downhole tool through an outlet port in one of the first cap and the second cap.

8. The method of claim 1, wherein the downhole tool is one of transported and stored while retaining the fluid inside the downhole tool.

9. The method of claim 1, wherein the fluid comprises a corrosion inhibitor.

10. The method of claim 9, wherein the fluid comprises an anti-scaling agent.

11. The method of claim 1, further comprising isolation of a communication bus connector in the downhole tool from the fluid by engaging the communication bus connector in the downhole tool with a communication bus seal member that is coupled with one of the first cap and the second cap.

12. The method of claim 1, further comprising discharging the fluid from the downhole tool when a pressure in the downhole tool is at a designated value.

13. A method of treating a downhole tool used in a wellbore comprising:
introducing a fluid into the downhole tool after being used in a first wellbore containing a wellbore fluid;
retaining the fluid in the downhole tool so that destructive processes due to residual wellbore fluid in the downhole tool are mitigated; and
draining the fluid from the downhole tool prior to a usage in the first wellbore or a second wellbore.

14. The method of claim 13, wherein the step of retaining comprises selectively coupling caps to openings of the downhole tool.

15. A system for treating a downhole tool used in a wellbore comprising:
a first opening and a second opening in the downhole tool;
a first cap that selectively mounts to and seals the first opening in the downhole tool;
a second cap that selectively mounts to and seals the second opening in the downhole tool;
a source of a fluid;
an inlet port in the first cap, the inlet port selectively coupled with the source of the fluid, wherein the fluid flows through the inlet port in the first cap into the downhole tool;
and
a pressure relief member in one of the first cap or the second cap.

16. The system of claim 15, wherein the downhole tool comprises an inner bore, the inner bore extends through the downhole tool along a longitudinal axis of the downhole tool, and wherein the first opening is connected to one end of the inner bore and the second opening is connected to the other end of the inner bore.

17. The system of claim 16, wherein the inlet port comprises a fitting.

18. The system of claim 17, wherein the fitting comprises a fluid channel, and at least a portion of the fluid channel in the fitting is substantially perpendicular to the longitudinal axis of the downhole tool.

19. The system of claim 15, wherein at least one of the first cap and the second cap comprises an outlet port.

20. The system of claim 15, further comprising a screen member in one of the first cap and the second cap, wherein the screen member comprises at least one aperture.

21. The system of claim 15, further comprising a communication bus seal member, the communication bus seal member sealing a tool communication bus connector of the downhole tool.

22. The system of claim 15, further comprising an inner cap communication bus connector in at least one of the first cap and the second cap, the inner cap communication bus connector connecting a tool communication bus connector, wherein at least one of the first cap and the second cap comprises an outer cap communication bus connector at an outer surface of the first cap or the second cap.

* * * * *